US012025133B2

(12) United States Patent
Nozaki et al.

(10) Patent No.: US 12,025,133 B2
(45) Date of Patent: Jul. 2, 2024

(54) COMPRESSOR AND AIR-CONDITIONER

(71) Applicant: HITACHI-JOHNSON CONTROLS AIR CONDITIONING, INC., Tokyo (JP)

(72) Inventors: Tsutomu Nozaki, Tokyo (JP); Kazuyuki Matsunaga, Tokyo (JP); Ryo Kurono, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 345 days.

(21) Appl. No.: 17/421,099

(22) PCT Filed: Dec. 25, 2019

(86) PCT No.: PCT/JP2019/050810
§ 371 (c)(1),
(2) Date: Jul. 7, 2021

(87) PCT Pub. No.: WO2020/202676
PCT Pub. Date: Oct. 8, 2020

(65) Prior Publication Data

US 2022/0106952 A1 Apr. 7, 2022

(30) Foreign Application Priority Data

Apr. 3, 2019 (WO) ..... PCT/JP2019/014882

(51) Int. Cl.
*F04C 29/04* (2006.01)
*F04B 39/02* (2006.01)
(Continued)

(52) U.S. Cl.
CPC ..... *F04C 29/045* (2013.01); *F04C 18/02* (2013.01); *F04C 18/0215* (2013.01);
(Continued)

(58) Field of Classification Search
CPC .. F04C 23/008; F04C 18/0215; F04C 29/026; F04C 29/045; F04C 29/028;
(Continued)

(56) References Cited

U.S. PATENT DOCUMENTS 7,670,120 B2 * 3/2010 Ginies ..... F04C 29/023 418/94
7,771,180 B2 * 8/2010 Cho ..... F04C 29/026 418/55.6
(Continued)

FOREIGN PATENT DOCUMENTS

JP 2002-098056 A 4/2002
JP 2002-317775 A 10/2002
(Continued)

OTHER PUBLICATIONS

International Search Report of PCT/JP2019/050810 dated Mar. 10, 2020.
(Continued)

*Primary Examiner* — Peter J Bertheaud
(74) *Attorney, Agent, or Firm* — MATTINGLY & MALUR, PC

(57) ABSTRACT

Provided is, e.g., a compressor with a high reliability. A compressor (100) includes a hermetic container (1) sealed with lubricant oil, an electric motor (6) placed inside the hermetic container (1) and having a stator (6*a*) and a rotor (6*b*), a crankshaft (3) configured to rotate integrally with the rotor (6*b*), a compression mechanism (2) configured to compress refrigerant in association with rotation of the crankshaft (3), a discharge pipe (Pb) configured to guide the refrigerant compressed in the compression mechanism (2) to the outside of the hermetic container (1), and a tubular oil ring (15) provided between the compression mechanism (2) and the electric motor (6). A cutout (s1) is, at a lower portion
(Continued)

of the oil ring (15), provided as a first insertion portion into which the discharge pipe (Pb) is inserted.

10 Claims, 13 Drawing Sheets

(51) Int. Cl.

| | |
|---|---|
| ***F04B 39/04*** | (2006.01) |
| ***F04C 18/02*** | (2006.01) |
| ***F04C 23/00*** | (2006.01) |
| ***F04C 29/00*** | (2006.01) |
| ***F04C 29/02*** | (2006.01) |

(52) U.S. Cl.
CPC ..... *F04C 23/008* (2013.01); *F04C 29/0085* (2013.01); *F04C 29/02* (2013.01); *F04C 29/026* (2013.01); *F04C 29/028* (2013.01); *F04B 39/02* (2013.01); *F04B 39/04* (2013.01); *F04C 2240/30* (2013.01); *F04C 2240/603* (2013.01); *F04C 2240/807* (2013.01)

(58) Field of Classification Search
CPC .. F04C 29/0085; F04C 29/12; F04C 2240/30; F04C 2240/807; F04C 2240/603; F04C 18/02; F04C 29/00
See application file for complete search history.

(56) References Cited

U.S. PATENT DOCUMENTS

| | | | | |
|---|---|---|---|---|
| 8,167,595 | B2 * | 5/2012 | Duppert | F04B 39/16 418/55.6 |
| 9,885,357 | B2 * | 2/2018 | Yokoyama | F04C 18/0215 |
| 9,897,360 | B2 * | 2/2018 | Yura | F25B 49/022 |
| 2002/0034451 | A1 | 3/2002 | Abe et al. | |

FOREIGN PATENT DOCUMENTS

| | | | |
|---|---|---|---|
| JP | 2003-003974 | A | 1/2003 |
| JP | 2004-239099 | A | 8/2004 |
| JP | 2015-109732 | A | 6/2015 |
| JP | 2016-113901 | A | 6/2016 |

OTHER PUBLICATIONS

Japanese Office Action received in corresponding Japanese Application No. JP2020-538734 dated Aug. 25, 2020.
Japanese Office Action received in corresponding Japanese Application No. JP2020-193161 Dec. 8, 2020.

* cited by examiner

COMPRESSOR AND AIR-CONDITIONER

TECHNICAL FIELD

The present invention relates to a compressor and an air-conditioner.

BACKGROUND ART

Normally, a compressor used for, e.g., an air-conditioner is sealed with lubricant oil. When such lubricant oil flows out of the compressor through a discharge pipe, a lack of lubrication of a sliding portion of the compressor is caused, and degradation of the efficiency of a refrigeration cycle is caused. For example, a technique described in Patent Literature 1 has been known as the technique of reducing such outflow of the lubricant oil.

That is, Patent Literature 1 describes a scroll compressor provided with an annular partition member configured to separate lubricant oil flowing from an oil return passage and compressed gas discharged from a refrigerant gas passage.

CITATION LIST

Patent Literature

PATENT LITERATURE 1: JP-A-2003-3974

SUMMARY OF INVENTION

Problems to be Solved by Invention

However, in the technique described in Patent Literature 1, an upstream end of the discharge pipe is positioned outside the partition member. As a result, there is a probability that part of misty lubricant oil flowing down through a clearance (the above-described oil return passage) between a fixed scroll and a hermetic container flows out through the discharge pipe. For this reason, it has been demanded to further reduce outflow of lubricant oil and enhance the reliability of the compressor.

Thus, the present invention is intended to provide, e.g., a compressor with a high reliability.

Solution to Problems

For solving the above-described problems, the compressor according to the present invention includes a tubular partition wall provided between a compression mechanism and an electric motor and a balance weight provided inside the partition wall in a radial direction in a space on a lower side of the compression mechanism and an upper side of the electric motor and configured to rotate integrally with a drive shaft. A cutout or a hole is, at a lower portion of the partition wall, provided as a first insertion portion into which a discharge pipe is inserted. At least one first flow path connecting one side and the other side of a stator in an axial direction is, at the stator, provided as a groove provided at an outer peripheral wall of the stator. At least one second flow path connecting one side and the other side of the compression mechanism in an axial direction of the drive shaft is, at the compression mechanism, provided as a groove provided at an outer peripheral wall of the compression mechanism. A clearance is formed between the partition wall and a hermetic container. An upstream end of the discharge pipe is provided at a position inside the clearance divided by the partition wall between upper and lower surfaces of the balance weight in the axial direction of the drive shaft. Gas having flowed down through the second flow path flows down while revolving through the clearance. The gas having flowed down while revolving through the clearance is guided to a lower side of the electric motor through the first flow path. A peripheral wall of the tubular partition wall is provided outside an inner peripheral surface of the stator in a radial direction. The upstream end of the discharge pipe is also provided outside the inner peripheral surface of the stator in the radial direction.

In order to solve the problem described above, a compressor according to the present invention includes: a hermetic container sealed with lubricant oil; an electric motor placed inside the hermetic container and having a stator and a rotor; a drive shaft configured to rotate integrally with the rotor; a compression mechanism configured to compress gas in association with rotation of the drive shaft; a discharge pipe configured to guide the gas compressed in the compression mechanism to an outside of the hermetic container; a tubular partition wall provided between the compression mechanism and the electric motor; and a balance weight provided inside the partition wall in a radial direction in a space on a lower side of the compression mechanism and an upper side of the electric motor and configured to rotate integrally with the drive shaft. In the compressor, a cutout or a hole is, at a lower portion of the partition wall, provided as a first insertion portion into which the discharge pipe is inserted, at least one first flow path connecting one side and the other side of the stator in an axial direction is, at the stator, provided as a groove provided at an outer peripheral wall of the stator, at least one second flow path connecting one side and the other side of the compression mechanism in an axial direction of the drive shaft is, at the compression mechanism, provided as a groove provided at an outer peripheral wall of the compression mechanism, a clearance is formed between the partition wall and the hermetic container, gas having flowed down through the second flow path flows down while revolving through the clearance, the gas having flowed down while revolving through the clearance is guided to a lower side of the electric motor through the first flow path, the partition wall is provided outside a winding of the stator in the radial direction, and a length of protrusion of an upstream end of the discharge pipe into the partition wall is shorter than a distance between the upstream end of the discharge pipe and the balance weight. Note that other points will be described in embodiments.

Effects of Invention

According to the present invention, e.g., the compressor with the high reliability can be provided.

DESCRIPTION OF EMBODIMENTS

First Embodiment

<Configuration of Compressor>

Figure 1:
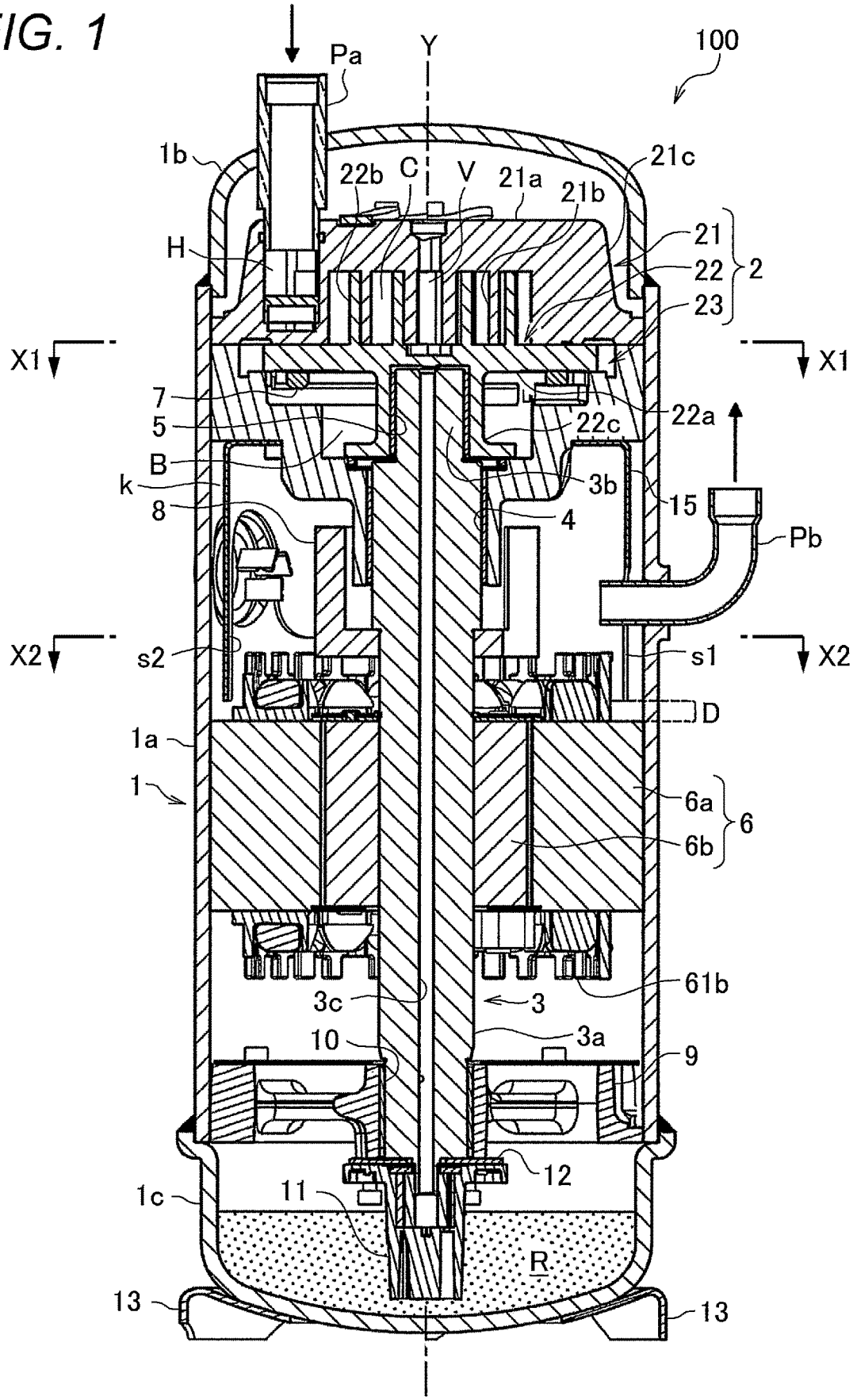
FIG. 1 is a longitudinal sectional view of a compressor according to a first embodiment of the present invention.

FIG. 1 is a longitudinal sectional view of a compressor 100 according to a first embodiment. The compressor 100 shown in FIG. 1 is equipment configured to compress gaseous refrigerant. As shown in FIG. 1, the compressor 100 includes a hermetic container 1, a compression mechanism 2, a crankshaft 3 (a drive shaft), a main bearing 4, a revolving bearing 5, an electric motor 6, an Oldham ring 7, and a balance weight 8. In addition to the above-described configuration, the compressor 100 includes a sub-frame 9, an auxiliary bearing 10, an oil supply pump 11, a thrust bearing 12, legs 13, an oil return pipe 14 (see FIG. 3), and an oil ring 15 (a partition wall).

The hermetic container 1 is a shell-shaped container housing the compression mechanism 2, the crankshaft 3, the electric motor 6, the oil ring 15 and the like, and is substantially hermetically closed. The hermetic container 1 is sealed with lubricant oil for enhancing lubricity in the compressor 100, and the lubricant oil is stored at a bottom portion as an oil sump R in the hermetic container 1. The hermetic container 1 includes a cylindrical tubular chamber 1*a*, a lid chamber 1*b* welded to an upper portion of the tubular chamber 1*a*, and a bottom chamber 1*c* welded to a lower portion of the tubular chamber 1*a*.

As shown in FIG. 1, a suction pipe Pa is inserted and fixed into the lid chamber 1*b* of the hermetic container 1. The suction pipe Pa is a pipe for guiding refrigerant to a suction chamber H of the compression mechanism 2. Moreover, a discharge pipe Pb is inserted and fixed into the tubular chamber 1*a* of the hermetic container 1. The discharge pipe Pb is a pipe for guiding refrigerant (gas) compressed in the compression mechanism 2 to the outside of the compressor 100.

The compression mechanism 2 is a mechanism configured to compress refrigerant in association with rotation of the crankshaft 3. The compression mechanism 2 includes a fixed scroll 21, a revolving scroll 22, and a frame 23, and is arranged in an upper space in the hermetic container 1.

The fixed scroll 21 is a fixed member fixed into the hermetic container 1. The fixed scroll 21 includes a discoid base plate 21*a*, a spiral wrap 21*b* (also see FIG. 2) standing on the base plate 21*a*, and a tubular support portion 21*c* surrounding the wrap 21*b*. As shown in FIG. 1, a lower surface (a surface on a revolving scroll 22 side) of the support portion 21*c* and a lower end of the wrap 21*b* are substantially flush with each other. Moreover, the suction chamber H to which refrigerant is guided through the suction pipe Pa is provided in the vicinity of a peripheral edge of the base plate 21*a* of the fixed scroll 21.

The revolving scroll 22 is a movement member configured to revolve (move) to form a compression chamber C between the revolving scroll 22 and the fixed scroll 21. The revolving scroll 22 includes a discoid base plate 22*a*, a spiral wrap 22*b* (also see FIG. 2) standing on the base plate 22*a*, and a boss portion 22*c* fitted onto an upper end portion of the crankshaft 3. As shown in FIG. 1, the wrap 22*b* extends upward of the base plate 22*a*, and the boss portion 22*c* extends downward of the base plate 22*a*.

Figure 2:
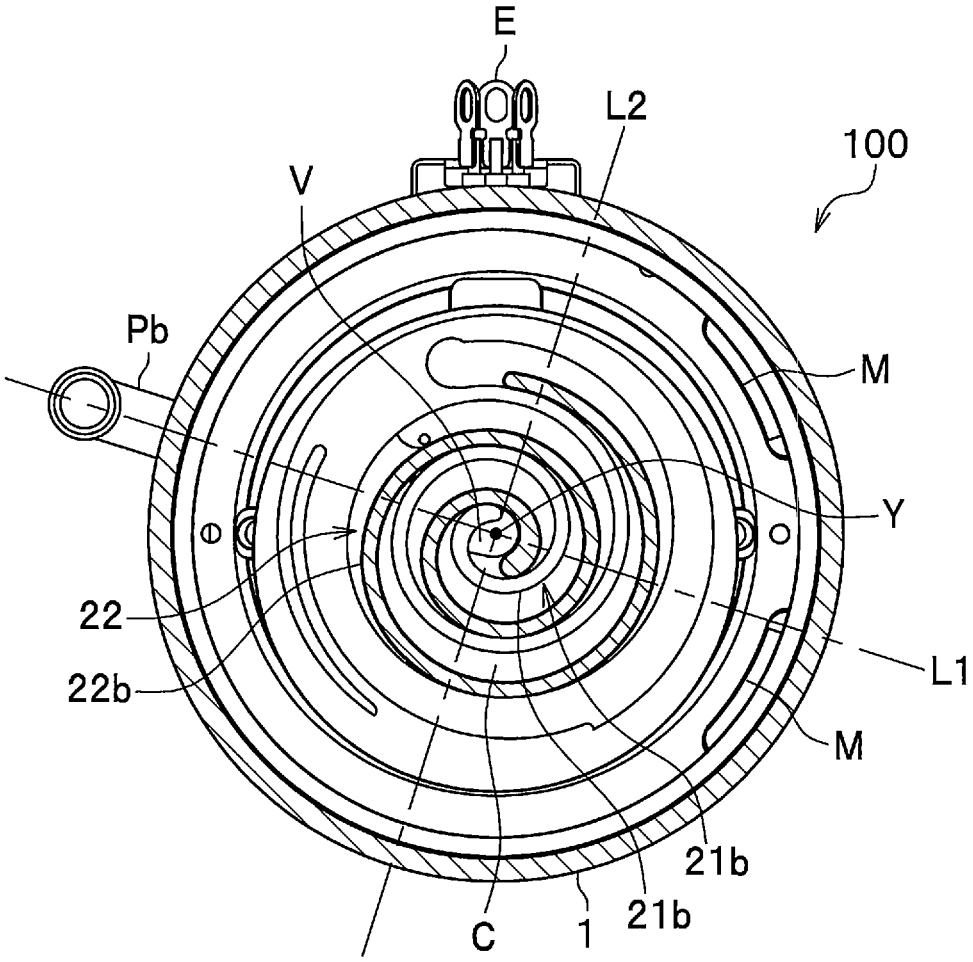
FIG. 2 is a cross-sectional view of the compressor according to the first embodiment of the present invention along an X1-X1 line of FIG. 1.

FIG. 2 is a cross-sectional view of the compressor 100 along an X1-X1 line of FIG. 1. As shown in FIG. 2, the spiral wrap 21*b* of the fixed scroll 21 and the spiral wrap 22*b* of the revolving scroll 22 engage with each other to form the compression chamber C between the wraps 21*b*, 22*b*. The above-described compression chamber C is a space where gaseous refrigerant is compressed, and is formed on each of external and internal line sides of the wrap 22*b* of the revolving scroll 22. Moreover, a discharge port V for guiding refrigerant compressed in the compression chamber C to the upper space in the hermetic container 1 is provided in the vicinity of the center of the base plate 21*a* of the fixed scroll 21.

The frame 23 shown in FIG. 1 is a member for supporting the revolving scroll 22 and fixing the main bearing 4. The frame 23 is in a substantially rotational symmetrical shape, and is fastened to the lower side of the fixed scroll 21. Moreover, the frame 23 is fixed to the hermetic container 1. A hole (a reference numeral is not shown) into which the crankshaft 3 is inserted is provided at the frame 23.

Figure 3:
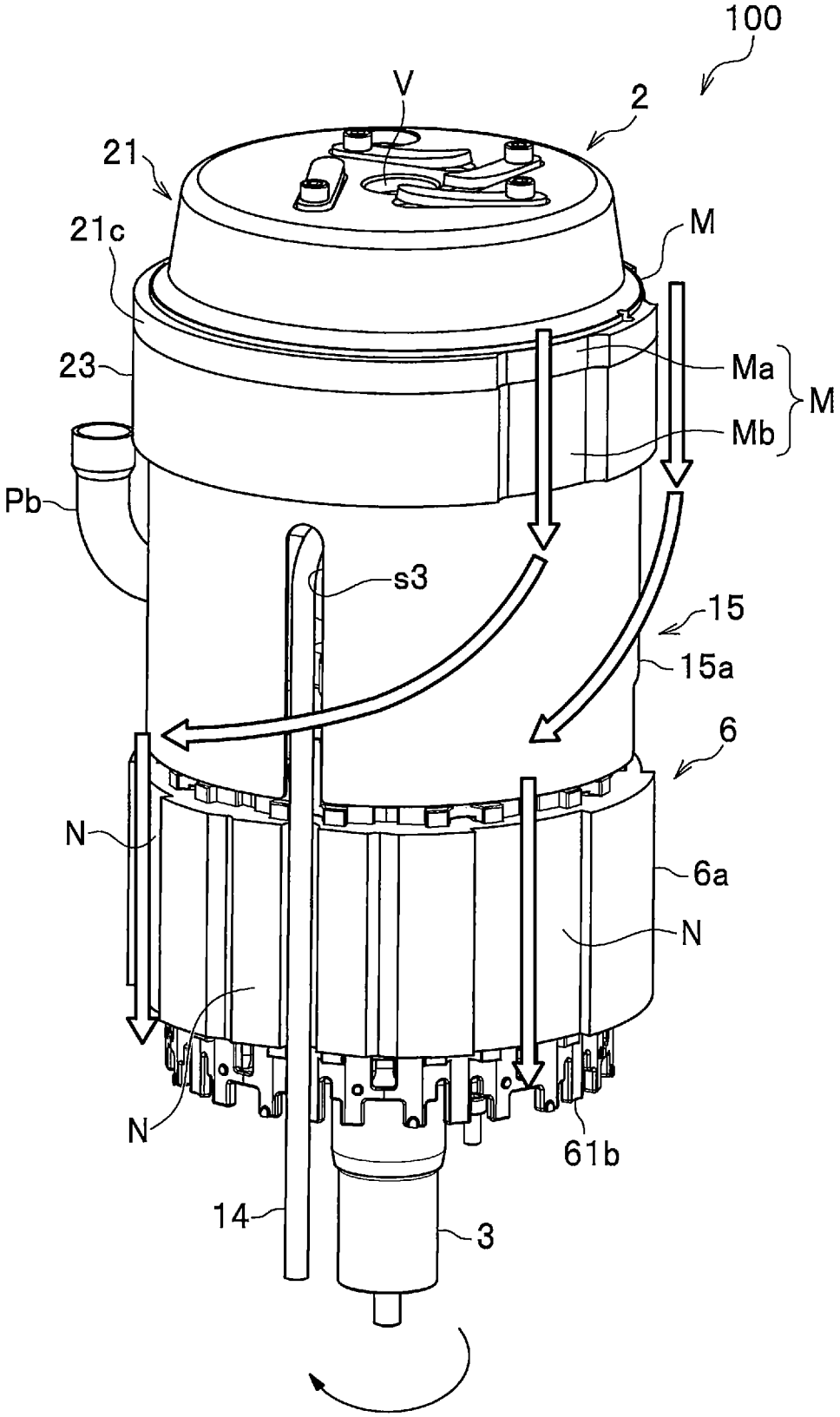
FIG. 3 is a perspective view in a state in which a hermetic container and the like of the compressor according to the first embodiment of the present invention are removed.

FIG. 3 is a perspective view in a state in which the hermetic container 1 and the like of the compressor 100 are removed. Note that white arrows of FIG. 3 indicate the flow of misty lubricant oil. Moreover, an arrow on the lower side of the crankshaft 3 in FIG. 3 indicates the direction of rotation of the crankshaft 3 (the same also applies to FIG. 4 below). In an example of FIG. 3, two refrigerant flow paths M (second flow paths) allowing connection between the upper side (one side) and the lower side (the other side) of the compression mechanism 2 in an axial direction are provided at the compression mechanism 2 (also see FIG. 2).

The above-described refrigerant flow path M is a flow path for guiding refrigerant and the like discharged to the upper space in the hermetic container 1 through the discharge port V of the compression mechanism 2 to the lower side of the compression mechanism 2. Note that gas flowing in the refrigerant flow path M is mixed not only with refrigerant but also with misty lubricant oil. Such gas will be referred to as "refrigerant and the like"

In the example shown in FIGS. 2 and 3, a groove Ma formed such that an outer peripheral wall of the above-described support portion 21*c* is recessed inwardly in a radial direction functions as part of the refrigerant flow path M. Similarly, a groove Mb formed such that an outer peripheral wall of the frame 23 is recessed inwardly in the radial direction functions as part of the refrigerant flow path M. The areas of these grooves Ma, Mb in a circumferential direction are substantially coincident with each other, and are sequentially arranged in the axial direction. Refrigerant and the like discharged through the discharge port V of the compression mechanism 2 are sequentially guided to a space on the lower side of the compression mechanism 2 through the grooves Ma, Mb.

More specifically, refrigerant and the like flow in a clearance between the groove Ma of the fixed scroll 21 and an inner peripheral surface of the hermetic container 1 (see FIG. 2), and further flow in a clearance between the groove Mb of the frame 23 and the inner peripheral surface of the hermetic container 1 (see FIG. 2). Thus, in the hermetic container 1, a space on the upper side of the compression mechanism 2 and a space on the lower side of the frame 23 are predetermined discharge pressure spaces where the pressures thereof are substantially equal to a refrigerant discharge pressure.

As shown in FIG. 1, a space between the back side of the base plate 22*a* of the revolving scroll 22 and the frame 23 functions as a back pressure chamber B. That is, a predetermined back pressure acts on the revolving scroll 22 by a back pressure adjustment valve (not shown) such that the revolving scroll 22 is pressed against the fixed scroll 21.

Note that as shown in FIG. 2, the two refrigerant flow paths M (the second flow paths) are preferably unevenly provided on the opposite side of the discharge pipe Pb in the circumferential direction. For example, a line passing through the position of insertion of the discharge pipe Pb and the center axis Y of the crankshaft 3 and extending perpendicularly to the center axis Y is taken as a line L1. Moreover, a line crossing perpendicularly to both of the line L1 and the center axis Y of the crankshaft 3 is taken as a line L2.

The two refrigerant flow paths M may be (unevenly) provided on the opposite side of the above-described line L2 from the discharge pipe Pb. With this configuration, a length in the circumferential direction from the refrigerant flow path M to the discharge pipe Pb is sufficiently ensured as viewed in a cross section. This can suppress misty lubricant oil flowing down in the refrigerant flow path M from flowing out through the discharge pipe Pb.

Returning to FIG. 1, description will be continued. The crankshaft 3 is a shaft to be rotated integrally with a rotor 6*b* of the electric motor 6, and extends in an upper-lower direction. As shown in FIG. 1, the crankshaft 3 includes a main shaft 3*a* and an eccentric portion 3*b* extending upward of the main shaft 3*a*.

The main shaft 3*a* is coaxially fixed to the rotor 6*b* of the electric motor 6, and is rotated integrally with the rotor 6*b*. The eccentric portion 3*b* is a shaft to be rotated eccentrically with respect to the main shaft 3*a*, and is fitted in the boss portion 22*c* of the above-described revolving scroll 22. The eccentric portion 3*b* eccentrically rotates, and the revolving scroll 22 revolves accordingly.

The main bearing 4 is for pivotably supporting an upper portion of the main shaft 3*a* such that the main shaft 3*a* is rotatable relative to the frame 23, and is fixed to a peripheral wall surface of the hole (the reference numeral is not shown) of the frame 23. The revolving bearing 5 is for pivotably supporting the eccentric portion 3*b* such that the eccentric portion 3*b* is rotatable relative to the boss portion 22*c* of the revolving scroll 22, and is fixed to an inner peripheral wall of the boss portion 22*c*.

Note that an oil passage 3*c* in which lubricant oil flows is provided inside the crankshaft 3. Lubricant oil flowing through the oil passage 3*c* is guided not only to the compression mechanism 2 but also to the main bearing 4, the revolving bearing 5, the auxiliary bearing 10 and the like.

The electric motor 6 is a drive source configured to rotate the crankshaft 3, and is placed inside the hermetic container 1. In an example shown in FIG. 1, the electric motor 6 is, in the upper-lower direction, arranged between the oil ring 15 and the sub-frame 9. The electric motor 6 includes a stator 6*a* and the rotor 6*b*. The stator 6*a* is fixed to an inner peripheral wall of the tubular chamber 1*a* by, e.g., press-fitting. The rotor 6*b* is rotatably arranged inside the stator 6*a* in the radial direction.

The Oldham ring 7 is a ring-shaped member configured to revolve the revolving scroll 22 in response to eccentric rotation of the eccentric portion 3*b* without rotating the revolving scroll 22. The Oldham ring 7 is provided between the revolving scroll 22 and the frame 23. The balance weight 8 is a member for reducing vibration of the compressor 100, and is provided inside the oil ring 15 in the radial direction. More specifically, the balance weight 8 is provided inside the oil ring 15 (the partition wall) in the radial direction in a space (a space between the compression mechanism 2 and the electric motor 6) on the lower side of the compression mechanism 2 and the upper side of the electric motor 6.

Figure 4:
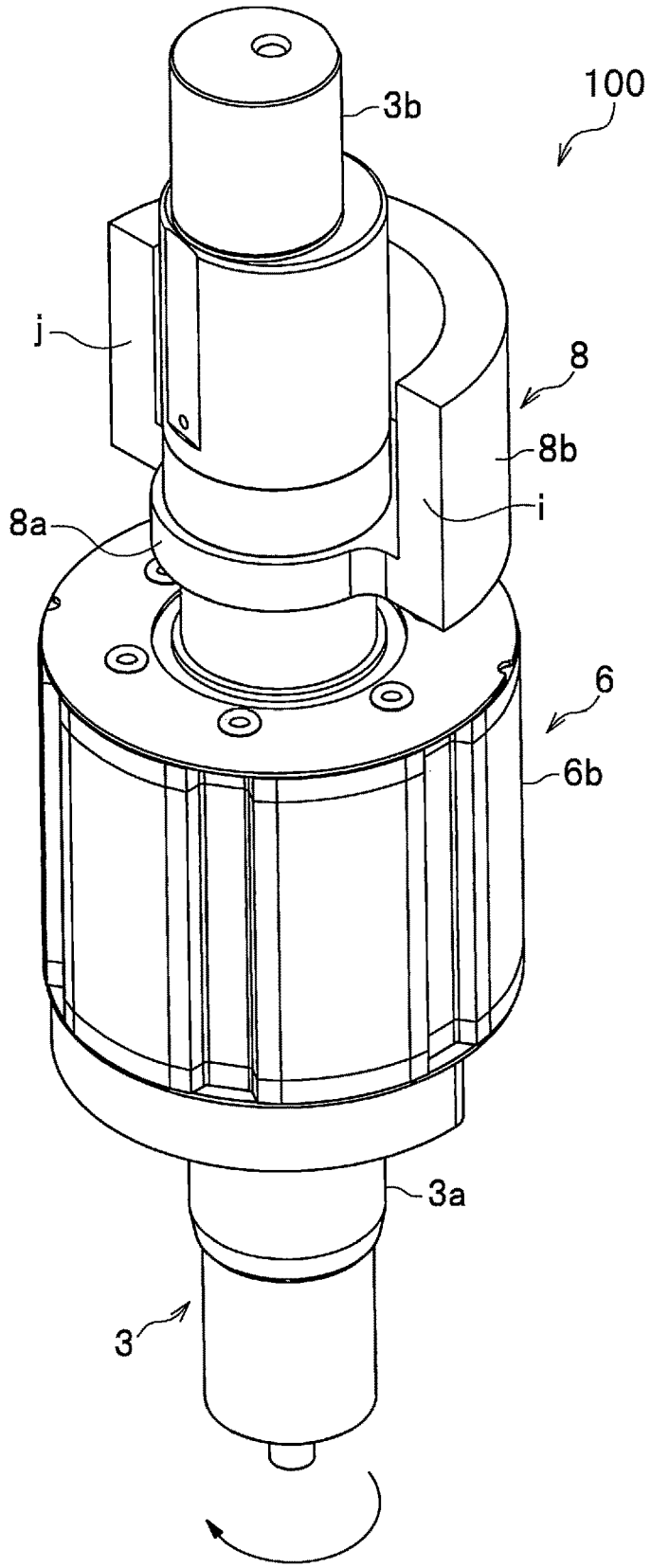
FIG. 4 is a perspective view including a crankshaft, an electric motor, and a balance weight of the compressor according to the first embodiment of the present invention.

FIG. 4 is a perspective view including the crankshaft 3, the electric motor 6, and the balance weight 8. As shown in FIG. 4, the balance weight 8 includes an annular portion 8*a* in an annular shape and an arc portion 8*b* in an arc shape as viewed in a cross section.

The annular portion 8*a* is fixed to the crankshaft 3 with the crankshaft 3 being inserted into a hole (a reference numeral is not shown) of the annular portion 8*a*. The arc portion 8*b* is, as viewed in a cross section, in the arc shape surrounding a half peripheral portion of the crankshaft 3, and extends upward of the annular portion 8*a* in the axial direction. In association with drive of the electric motor 6, the balance weight 8 rotates integrally with the crankshaft 3.

The sub-frame 9 shown in FIG. 1 is for pivotably supporting a lower portion of the crankshaft 3 such that the crankshaft 3 is rotatable, and is fixed to an inner peripheral wall of the hermetic container 1. The auxiliary bearing 10 is a bearing pivotably supporting the lower portion of the crankshaft 3 and receiving a load in the radial direction from the crankshaft 3. The auxiliary bearing 10 is fixed to a hole (a reference numeral is not shown) of the sub-frame 9 by, e.g., press-fitting.

The oil supply pump 11 is a pump configured to suck up lubricant oil from the oil sump R of the hermetic container 1 to supply the lubricant oil to the oil passage 3*c*, and is placed at a lower end portion of the crankshaft 3. For example, a trochoid pump is used as the oil supply pump 11. The thrust bearing 12 is a bearing configured to receive a load in the axial direction from the crankshaft 3, and is placed in the vicinity of a lower end of the crankshaft 3. The legs 13 are for supporting the hermetic container 1, and are placed on the bottom chamber 1*c*.

The oil return pipe 14 shown in FIG. 3 is a pipe for guiding part of lubricant oil contained in refrigerant and the like (gas) of the compression mechanism 2 to the oil sump R of the hermetic container 1. Specifically, lubricant oil having passed through the main bearing 4 returns to the oil sump R (see FIG. 1) through the oil return pipe 14. In the example shown in FIG. 3, the oil return pipe 14 extends elongated in a longitudinal direction, and in the vicinity of an upper end of the oil return pipe 14, bends inwardly in the radial direction in an L-shape.

The oil ring 15 shown in FIG. 1 is a tubular "partition wall" dividing an upstream end of the discharge pipe Pb and the refrigerant flow paths M (see FIGS. 2 and 3) of the compression mechanism 2, and is provided between the compression mechanism 2 and the electric motor 6. As shown in FIG. 1, the oil ring 15 is fixed to the frame 23 with the oil ring 15 contacting the frame 23 of the compression mechanism 2.

Next, the configuration of the oil ring 15 will be described in detail after the flow of refrigerant and the like in the hermetic container 1 has been briefly described. When the revolving scroll 22 revolves by drive of the electric motor 6 shown in FIG. 1, the volume of the compression chamber C sequentially formed by such revolving decreases, and refrigerant and the like are compressed. The compressed refrigerant and the like are discharged to the upper space in the hermetic container 1 through the discharge port V of the fixed scroll 21.

The refrigerant and the like discharged through the discharge port V are guided to the space on the lower side of the compression mechanism 2 through the above-described refrigerant flow paths M (see the white arrows of FIG. 3). In the space on the lower side of the compression mechanism 2, the refrigerant and the like are agitated by rotation of the balance weight 8. Thus, the speed vector of the refrigerant and the like guided to the space on the lower side of the compression mechanism 2 is the sum of a speed vector in the axial direction and a speed vector in the circumferential direction (the same direction as the direction of rotation of the balance weight 8).

Figure 13:
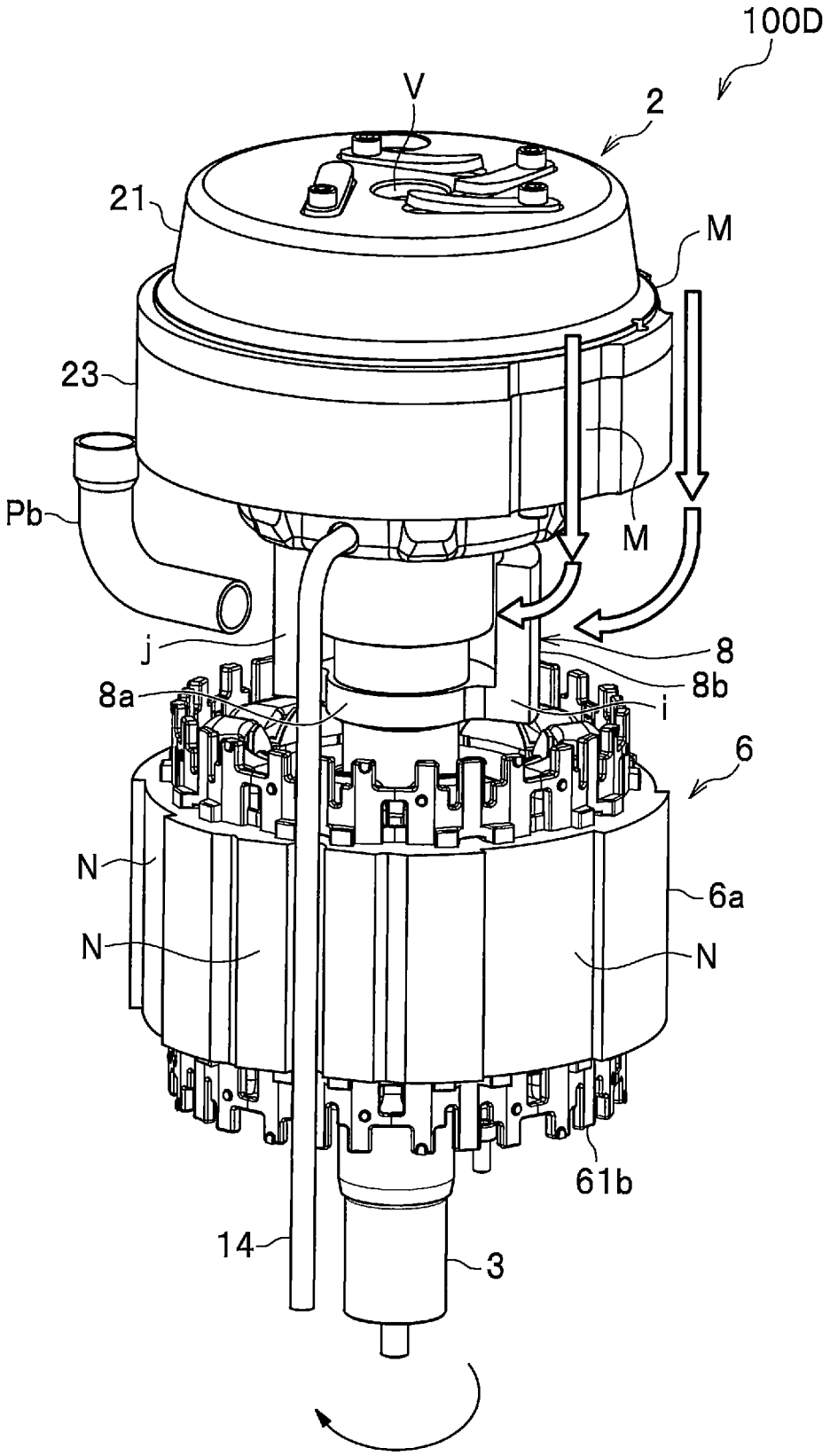
FIG. 13 is a perspective view in a state in which a hermetic container and the like are removed from a compressor according to a comparative example with no oil ring.

FIG. 13 is a perspective view in a state in which a hermetic container 1 and the like are removed from a compressor 100D according to a comparative example including no oil ring 15. Note that white arrows of FIG. 13 indicate the flow of misty lubricant oil. Moreover, an arrow on the lower side of a crankshaft 3 in FIG. 13 indicates the direction of rotation of the crankshaft 3. Of two end surfaces of an arc portion 8*b* of a balance weight 8 in a circumferential direction, a front surface in the direction of rotation of the balance weight 8 will be hereinafter referred to as a "movement front surface i," and a back surface in the direction of rotation of the balance weight 8 will be hereinafter referred to as a "movement back surface j."

Refrigerant and the like collide with the movement front surface i of the balance weight 8 in association with rotation of the balance weight 8. Thus, a pressure is higher in the vicinity of the movement front surface i than at the periphery thereof. On the other hand, refrigerant and the like are less likely to collide with the movement back surface j of the balance weight 8. Thus, a pressure is lower in the vicinity of the movement back surface j than at the periphery thereof. As a result, in the configuration of the comparative example of FIG. 13, refrigerant and the like having flowed down through refrigerant flow paths M of a compression mechanism 2 move while revolving diagonally downwardly to the movement back surface j of the balance weight 8, as indicated by the white arrows.

When misty lubricant oil is accumulated on the movement back surface j of the balance weight 8 as described above, the particle size of the lubricant oil gradually increases due to collision among particles. As a result, oil droplets of the lubricant oil drop onto an electric motor 6, and a liquid layer of the lubricant oil is formed on an upper surface of the electric motor 6. The lubricant oil accumulated on the upper surface of the electric motor 6 is agitated by rotation of the crankshaft 3, and turns into mist again. Part of such lubricant oil flows to the outside of the compressor 100D through a discharge pipe Pb.

Such outflow of the lubricant oil to the outside of the compressor 100D leads to degradation of lubricity of each sliding portion of the compressor 100D and degradation of the efficiency of a refrigeration cycle including the compressor 100D. For these reasons, in the first embodiment (see FIG. 1), the tubular oil ring 15 is provided between the frame 23 and the electric motor 6, and with this configuration, outflow of lubricant oil from the compressor 100 is reduced.

Figure 5:
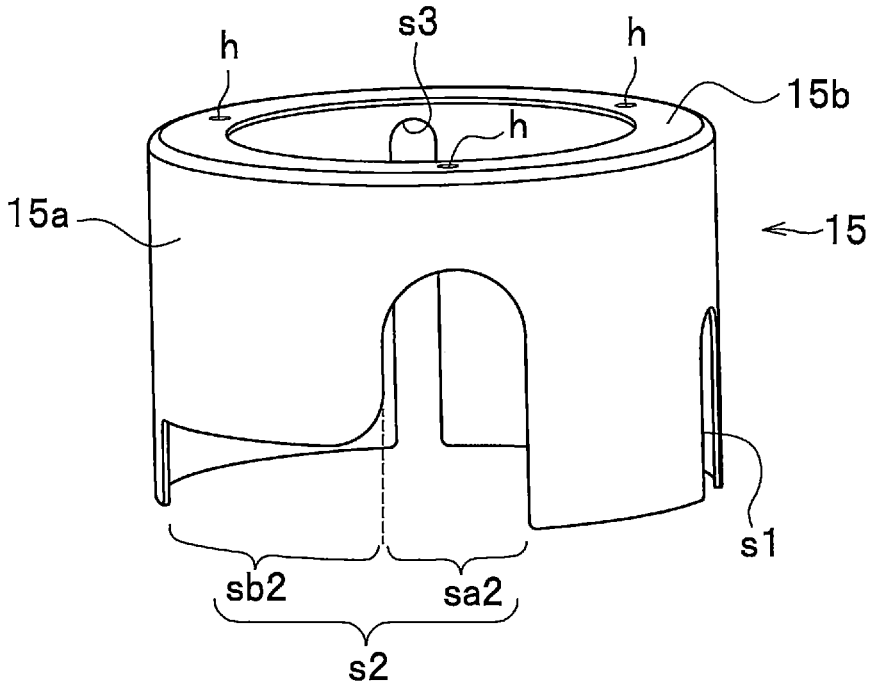
FIG. 5 is a perspective view of an oil ring included in the compressor according to the first embodiment of the present invention.

FIG. 5 is a perspective view of the oil ring 15 included in the compressor 100. As shown in FIG. 5, the oil ring 15 includes a thin cylindrical portion 15*a* in a cylindrical shape and a circular ring-shaped fixing portion 15*b* (a plate portion) extending inward of an upper end of the cylindrical portion 15*a* in the radial direction. The fixing portion 15*b* is a portion to be fixed to the frame 23 (see FIG. 1). In an example shown in FIG. 5, three holes h are, at the fixing portion 15*b*, provided at an interval of about 120° in the circumferential direction. Screws (not shown) are each inserted into the holes h, and are each screwed into screw holes (not shown) provided at a lower surface of the frame 23.

With this configuration, an upper surface of the oil ring 15 closely contacts the lower surface of the frame 23 (see FIG. 1) across the entire circumference in the circumferential direction. Thus, there is almost no clearance between the oil ring 15 and the frame 23. Note that right after having flowed out of the refrigerant flow paths M (see FIGS. 2 and 3), refrigerant and the like are mixed with a relatively large amount of misty lubricant oil, but there is almost no clearance between the oil ring 15 and the frame 23 as described above. This can suppress the misty lubricant oil from flowing toward the movement back surface j (see FIG. 4) of the balance weight 8.

Note that the upstream end of the discharge pipe Pb (see FIG. 1) is, as viewed in plane, preferably provided between an inner end portion of the fixing portion 15*b* (the plate portion) in the radial direction and an outer end portion of the fixing portion 15*b* in the radial direction. In other words, the upstream end of the discharge pipe Pb preferably overlaps with the fixing portion 15*b* as viewed in plane. According to this configuration, outflow of lubricant oil through the discharge pipe Pb can be reduced as compared to a configuration in which the upstream end of the discharge pipe Pb extends radially inward of the inner end portion of the fixing portion 15*b* in the radial direction. For example, even if oil droplets of lubricant oil are accumulated on the movement back surface j (see FIG. 4) of the balance weight 8, outflow of the lubricant oil through the discharge pipe Pb can be reduced because a distance to the upstream end of the discharge pipe Pb is relatively long.

The cylindrical portion 15*a* shown in FIG. 5 has the function of dividing the upstream end of the discharge pipe Pb (see FIG. 1) and the refrigerant flow paths M of the compression mechanism 2 (see FIG. 3). The phrase of the cylindrical portion 15*a* "dividing" the discharge pipe Pb and the refrigerant flow paths M as described herein means that the direct flow of lubricant oil from the refrigerant flow paths M to the discharge pipe Pb is temporarily blocked by the cylindrical portion 15*a*. Note that even a case where the flow of lubricant oil from the refrigerant flow paths M to the discharge pipe Pb is not fully blocked is also included in the meaning of "dividing" described above as long as such a flow is reduced.

As shown in FIG. 1, a clearance k (an annular clearance) in the radial direction is provided between an outer peripheral surface of the cylindrical portion 15*a* and the inner peripheral surface of the hermetic container 1 across the entire circumference of the cylindrical portion 15*a*. Refrigerant and the like having flowed down through the refrigerant flow paths M of the compression mechanism 2 flow down while revolving through the clearance k between the cylindrical portion 15*a* and the hermetic container 1. That is, the cylindrical portion 15*a* of the oil ring 15 takes not only on the function of reducing outflow of lubricant oil from the discharge pipe Pb but also on the function of guiding the flow of refrigerant and the like Note that the diameter of the outer peripheral surface of the cylindrical portion 15*a* about the center axis Y of the crankshaft 3 is preferably equal to or less than the diameter of the bottom of the groove Ma, Mb (see FIG. 3) forming the refrigerant flow path M. According to such a configuration, the fixing portion 15*b* (see FIG. 5) of the oil ring 15 is hidden inside the above-described grooves Ma, Mb in the radial direction. Thus, interference with the flow of refrigerant and the like flowing down through the refrigerant flow paths M by the fixing portion 15*b* of the oil ring 15 can be prevented.

As shown in FIG. 5, three cutouts s1, s2, s3 are provided at the oil ring 15. The discharge pipe Pb (see FIG. 1) is inserted into the first cutout s1 (a first insertion portion). A power supply terminal E (also called a hermetic terminal: see FIG. 2) is inserted into the second cutout s2 (a second insertion portion). The power supply terminal E is a terminal to be connected to a winding 61*b* of the electric motor 6. The oil return pipe 14 (see FIG. 3) is inserted into the third cutout s3 (a third insertion portion). The positions and configurations of these cutouts s1, s2, s3 will be described later.

Figure 6:
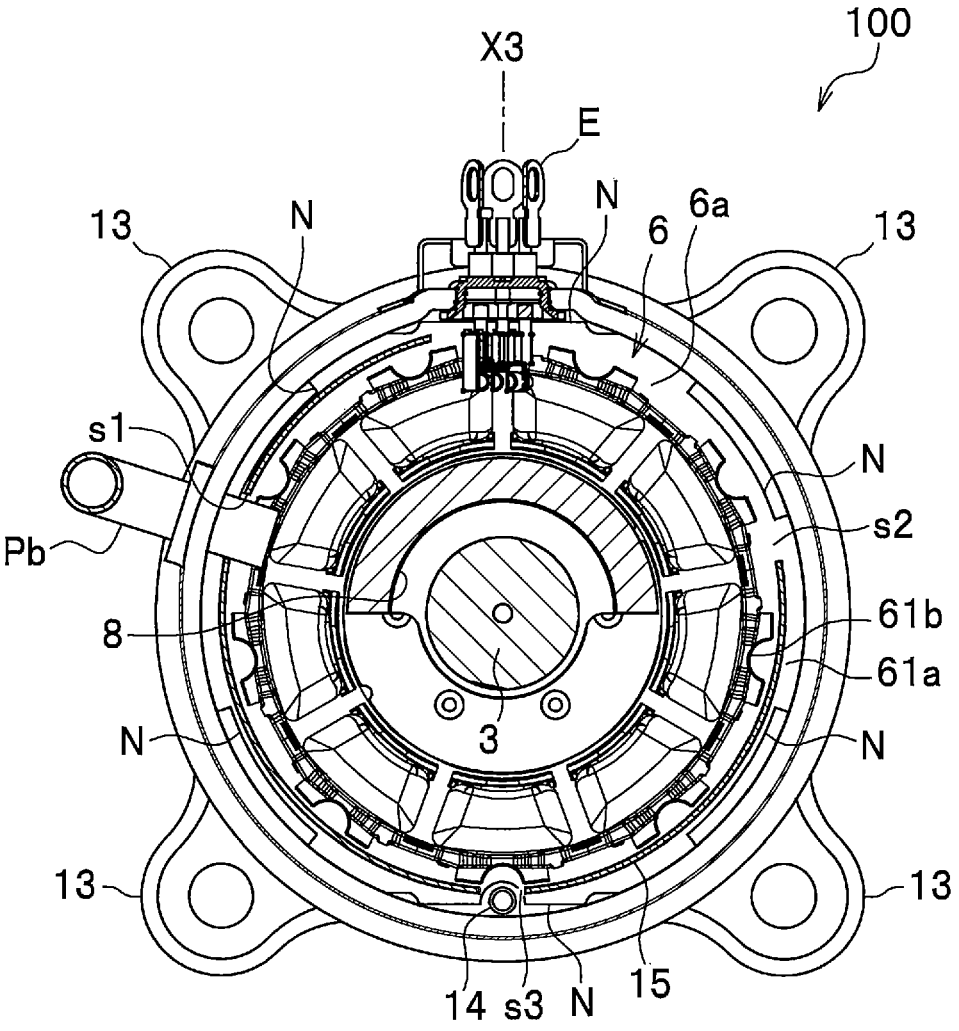
FIG. 6 is a cross-sectional view of the compressor according to the first embodiment of the present invention in a case where the compressor is cut along an X2-X2 line of FIG. 1.

FIG. 6 is a cross-sectional view in a case where the compressor 100 is cut along an X2-X2 line of FIG. 1. Note that the discharge pipe Pb and the power supply terminal E not actually seen in a case where the compressor 100 is cut along the X2-X2 line of FIG. 1 are shown in a projected manner in FIG. 6 for the sake of description. As shown in FIG. 6, the stator 6*a* of the electric motor 6 includes a core back 61*a* having a stack of magnetic steel sheets and the winding 61*b* wound around the core back 61*a* in a predetermined manner. Multiple oil flow paths N (first flow paths: also see FIG. 3) allowing connection between the upper side (one side) and the lower side (the other side) of the stator 6*a* in the axial direction are provided at the core back 61*a* of the stator 6*a*. Note that refrigerant and the like flowing in the "oil flow paths N" are mixed not only with misty lubricant oil but also with gaseous refrigerant.

The above-described oil flow path N is a flow path for guiding refrigerant and the like flowing in the annular clearance k (see FIG. 1) between the oil ring 15 and the hermetic container 1 to the lower side of the electric motor 6. That is, a groove formed such that an outer peripheral wall of the core back 61*a* of the stator 6*a* is recessed inwardly in the radial direction at a predetermined location in the circumferential direction is provided as the oil flow path N in the longitudinal direction.

In an example of FIG. 6, six oil flow paths N are provided at substantially equal intervals in the circumferential direction at the core back 61*a* of the stator 6*a*. Refrigerant and the like are guided to the lower side of the electric motor 6 through a clearance between each groove (each oil flow path N) of the core back 61*a* and the inner peripheral surface of the hermetic container 1.

The oil ring 15 is, as viewed in a cross section, preferably provided inside each oil flow path N in the radial direction. According to such a configuration, refrigerant and the like flowing in the annular clearance k (see FIG. 1) between the oil ring 15 and the hermetic container 1 are directly guided to the lower side of the electric motor 6 through the oil flow paths N of the core back 61*a*. Even in a case where misty lubricant oil is blown up through the oil flow paths N, entrance of such lubricant oil into the oil ring 15 can be reduced.

As shown in FIGS. 1 and 6, a lower end of the oil ring 15 (the partition wall) is, as viewed in a cross section, preferably provided inside inner wall surfaces of the oil flow paths N (the first flow paths) in the radial direction. According to such a configuration, refrigerant and the like flowing down while revolving through the annular clearance k (see FIG. 1) between the oil ring 15 and the hermetic container 1 are guided to the oil flow paths N while being guided in the vicinity of the lower end of the oil ring 15. Thus, the flow of lubricant oil through the oil flow paths N is less likely to be interfered as compared to a configuration in which the lower end of the oil ring 15 overlaps with the oil flow paths N as viewed in plane. Although details will be described later, a space D for ensuring an insulation distance is provided between the electric motor 6 and the oil ring 15 in the example of FIG. 1. Even in such a configuration, the oil ring 15 is provided inside the inner wall surfaces of the oil flow paths N in the radial direction as described above so that entrance of lubricant oil into the oil ring 15 through the space D can be reduced.

As viewed in a cross section including the cutouts s1, s2, s3 (a location where the discharge pipe Pb is inserted into the cutout s1 (the first insertion portion) of the oil ring 15) shown in FIG. 6, at least some of the six oil flow paths N preferably overlap with the oil ring 15 in the radial direction. In other words, as viewed in the cross section including the cutouts s1, s2, s3, at least some of the six oil flow paths N preferably overlap, in the radial direction, with a location without the cutouts s1, s2, s3 of the oil ring 15. Similarly, as viewed in the cross section, at least some of the six oil flow paths N preferably overlap, in the radial direction, with the lower end of the oil ring 15 including the cutouts s1, s2, s3. Note that the "cross section" as viewed in the cross section is a plane perpendicular to the center axis Y (see FIG. 1) of the crankshaft 3.

In a specific example, as viewed in the cross section including the cutouts s1, s2, s3, 60% or higher of the total of the lengths of the six oil flow paths N in the circumferential direction preferably overlaps with the oil ring 15 in the radial direction. Such a configuration can suppress lubricant oil flowing down while revolving through the annular clearance k (see FIG. 1) between the oil ring 15 and the hermetic container 1 from entering the oil ring 15 through clearances formed by the cutouts s1, s3, s3.

The oil ring 15 is preferably provided outside the winding 61*b* of the electric motor 6 in the radial direction as viewed in a cross section. According to such a configuration, gaseous refrigerant guided to the lower side of the electric motor 6 is less likely to enter the clearance k (see FIG. 1) between the oil ring 15 and the hermetic container 1 when such refrigerant is guided to a space inside the oil ring 15 through, e.g., a clearance formed by the winding 61*b*. After refrigerant and the like have moved to the lower side of the electric motor 6, a flow is formed such that misty lubricant oil is integrated with the oil sump R and gaseous refrigerant is blown up into the oil ring 15 and circulates.

Next, a positional relationship between the oil ring 15 and the balance weight 8 will be described. As shown in FIG. 1, the position of an upper surface (an end portion on a compression mechanism 2 side) of the balance weight 8 is, in the axial direction, preferably between the upper surface (an end portion on the compression mechanism 2 side) of the oil ring 15 and the lower end (an end portion on an electric motor 6 side) of the oil ring 15. Moreover, in the axial direction, the position of a lower surface (an end portion on the electric motor 6 side) of the balance weight 8 is preferably higher than the position of the lower end (the end portion on the electric motor 6 side) of the oil ring 15.

According to such a configuration, the balance weight 8 is within the oil ring 15 in the axial direction. This can suppress lubricant oil flowing in the annular clearance k between the oil ring 15 and the hermetic container 1 from flowing toward the balance weight 8. As a result, accumulation of lubricant oil on the movement back surface j (see FIG. 4) of the balance weight 8 can be reduced, and therefore, outflow of lubricant oil through the discharge pipe Pb can be reduced.

Note that in a case where the vicinity of the lower end of the oil ring 15 is, in the radial direction, relatively apart from the balance weight 8, it may be configured such that the height position of the lower surface of the balance weight 8 is lower than the height position of the lower end of the oil ring 15. Even with such a configuration, outflow of lubricant oil through the discharge pipe Pb can be reduced.

As shown in FIG. 1, the predetermined space D is preferably provided between the electric motor 6 and the oil ring 15 in the axial direction. More specifically, the predetermined space D is preferably provided between an upper surface of the core back 61*a* of the electric motor 6 and the lower end of the oil ring 15. With this configuration, a predetermined insulation distance can be ensured between the metal oil ring 15 and the electric motor 6. The oil ring 15 is made of metal such that the strength of the oil ring 15 is higher than that in a case where the oil ring 15 is made of resin. Thus, even in the configuration in which the three cutouts s1, s2, s3 are provided, deformation and damage of the oil ring 15 can be reduced. In the configuration in which the predetermined space (see the space D of FIG. 1) is formed between the electric motor 6 and the oil ring 15, deformation specifically in the vicinity of the lower end of the oil ring 15 can be more reduced in a case where the oil ring 15 is made of metal than in a case where the oil ring 15 is made of resin.

The upstream end of the discharge pipe Pb is preferably provided between the upper and lower surfaces of the balance weight 8 in the axial direction. According to such a configuration, the upstream end of the discharge pipe Pb is positioned higher than the lower surface of the balance weight 8. Thus, outflow of lubricant oil through the discharge pipe Pb can be reduced even in a case where lubricant oil dropped from the balance weight 8 and accumulated on the upper surface of the electric motor 6 turns into mist again. Moreover, even in a case where lubricant oil accumulated on an upper surface of the annular portion 8*a* (see FIG. 4) of the balance weight 8 turns into mist again and is blown up, outflow of lubricant oil through the discharge pipe Pb can be reduced because the upstream end of the discharge pipe Pb is positioned lower than the upper surface of the balance weight 8.

As described above, the three cutouts s1, s2, s3 are provided at the oil ring 15 shown in FIG. 5. The discharge pipe Pb (see FIG. 1) is inserted into the first cutout s1 (the first insertion portion). The cutout s1 is provided to extend in the longitudinal direction from the vicinity of the middle of the oil ring 15 in a height direction to the lower end of the oil ring 15, and opens at the lower end (the electric motor 6 side) of the oil ring 15. The vicinity of the upstream end of the discharge pipe Pb (see FIG. 1) is inserted through the cutout s1. As described above, at a lower portion (or the lower end) of the oil ring 15 (the partition wall), the cutout s1 is provided as the "first insertion portion" into which the discharge pipe Pb is inserted.

As shown in FIG. 1, the upstream end of the discharge pipe Pb is positioned inside the oil ring 15 in the radial direction. In other words, the upstream end of the discharge pipe Pb faces the inside of the oil ring 15. This can suppress lubricant oil flowing in the annular clearance k between the oil ring 15 and the hermetic container 1 from flowing out through the discharge pipe Pb. The cutout s1 (the first insertion portion) of the oil ring 15 as described herein is preferably provided between the upstream end of the discharge pipe Pb and an inner wall surface of the hermetic container 1 at a position closer to the inner wall surface of the hermetic container 1 than the upstream end of the discharge pipe Pb is to. According to this configuration, the radial distance of the annular clearance k between an outer peripheral surface of the oil ring 15 and the inner wall surface of the hermetic container 1 can be shortened. Thus, misty lubricant oil flowing down while revolving through the annular clearance k is likely to adhere to the outer peripheral surface of the oil ring 15 and the inner wall surface of the hermetic container 1 and turn into oil droplets.

As described above, the cutout s1 is provided at the lower portion of the oil ring 15 (the lower portion of the oil ring 15 is cut out). With this configuration, a length in the longitudinal direction between the upper surface of the oil ring 15 and the cutout s1 can be sufficiently ensured as compared to a configuration in which a cutout (not shown) is provided at an upper portion of the oil ring 15 (i.e., a configuration in which a cutout opens upward of the oil ring 15).

Note that the flow (turbulence) of refrigerant and the like inside the oil ring 15 also influences the flow of refrigerant and the like outside the oil ring 15 (in the annular clearance k) through the clearance between the oil ring 15 and the electric motor 6. However, as shown in FIG. 1, the cutout s1 into which the discharge pipe Pb is inserted is provided at the lower portion of the oil ring 15. That is, the cutout s1 is provided downstream of the flow of refrigerant and the like flowing down while revolving through the annular clearance k. Thus, an adverse effect of the flow (turbulence) of refrigerant and the like inside the oil ring 15 on the flow of refrigerant and the like in the annular clearance k can be reduced.

The position of the cutout s1 is at the lower portion of the oil ring 15, and therefore, the percentage of a component (a revolving component) in the circumferential direction in the speed vector of refrigerant and the like flowing through the annular clearance k can be decreased. Thus, a flow is likely to be generated such that refrigerant and the like flow down while moderately revolving through the annular clearance k. Further, the length in the longitudinal direction between the upper surface of the oil ring 15 and the cutout s1 can be sufficiently ensured, and therefore, misty lubricant oil flowing down while revolving through the annular clearance k (see FIG. 1) is likely to turn into oil droplets on the outer peripheral surface of the oil ring 15 and the inner wall surface of the hermetic container 1 before reaching the cutout s1.

Note that the configuration in which the cutout s1 opens downward of the oil ring 15 as shown in FIG. 5 (the configuration in which the cutout s1 is provided at the lower end of the oil ring 15) is included in a matter that the cutout s1 is provided at the "lower portion" of the oil ring 15.

The length of protrusion of the upstream end of the discharge pipe Pb into the oil ring 15 is preferably shorter than a distance between the upstream end of the discharge pipe Pb and the balance weight 8. According to such a configuration, even if a certain amount of lubricant oil is accumulated on the movement back surface j (see FIG. 4) of the balance weight 8, such lubricant oil is less likely to be scattered toward the discharge pipe Pb. Thus, outflow of lubricant oil through the discharge pipe Pb can be reduced. In combination of the above-described configuration in which the upstream end of the discharge pipe Pb is provided between the upper and lower surfaces of the balance weight 8, outflow of lubricant oil from the discharge pipe Pb can be effectively reduced.

The second cutout s2 (the second insertion portion) shown in FIG. 5 is a cutout for inserting the power supply terminal E (see FIG. 2) and drawing a power supply cable (not shown). In the example shown in FIG. 5, the cutout s2 larger than the cutout s1 (the first insertion portion) is, at the oil ring 15, provided as the "second insertion portion" into which the power supply terminal E is inserted. That is, the area of the cutout s2 is larger than the area of another cutout s1. The "area" of the cutout s1 is the area of a region of the oil ring 15 formed by a virtual circle including the lower end (multiple arc-shaped portions of which height positions are lowest) and the edge of the cutout s1. Note that the same also applies to the area of the cutout s2. Even with these cutouts s1, s2 and the like, the strength is ensured by use of the metal oil ring 15, and therefore, deformation and damage of the oil ring 15 can be reduced. The cutout s2 includes a terminal insertion portion sa2 into which the power supply terminal E is inserted and a wide portion sb2 for drawing the power supply cable (not shown). The terminal insertion portion sa2 is provided to extend in the longitudinal direction from a predetermined position of the oil ring 15 in the height direction to the lower end of the oil ring 15, and opens at the lower end of the oil ring 15.

The wide portion sb2 is provided across a predetermined area in the circumferential direction from a lower portion of the terminal insertion portion sa2, and opens at the lower end of the oil ring 15. That is, the wide portion sb2 is provided downstream of the terminal insertion portion sa2 in the circumferential direction in the direction (not shown in FIG. 5, see FIG. 3) of rotation of the crankshaft 3. The oil ring 15 is also present right above the power supply terminal E (see FIG. 2). With this configuration, disturbance of the flow of refrigerant and the like flowing down while revolving through the annular clearance k (see FIG. 1) between the oil ring 15 and the hermetic container 1 by the power supply terminal E can be reduced. Moreover, entrance of misty lubricant oil into the oil ring 15 through a clearance between the power supply terminal E and the cutout s2 can be reduced. Note that "right above" the power supply terminal E as described above means the upper side in the circumferential direction of the oil ring 15 within an area where the power supply terminal E is provided.

The oil return pipe 14 (see FIG. 3) is inserted into the third cutout s3 (the third insertion portion). That is, the cutout s3 is, at the oil ring 15, provided as the "third insertion portion" into which the oil return pipe 14 is inserted. The cutout s3 is provided elongated in the longitudinal direction to extend from the vicinity of the upper portion of the oil ring 15 in the height direction to the lower end of the oil ring 15, and opens at the lower end of the oil ring 15. Moreover, the oil ring 15 is also present right above the oil return pipe 14. With this configuration, disturbance of the flow of refrigerant and the like flowing down while revolving through the annular clearance k (see FIG. 1) between the oil ring 15 and the hermetic container 1 by the oil return pipe 14 can be reduced. Moreover, entrance of misty lubricant oil into the oil ring 15 through a clearance between the oil return pipe 14 and the cutout s3 can be reduced. Note that "right above" the oil return pipe 14 as described above means the upper side in the circumferential direction of the oil ring 15 within an area where the oil return pipe 14 is provided.

As shown in FIG. 3, the L-shaped oil return pipe 14 extending elongated in the longitudinal direction is inserted into the cutout s3. Note that almost the entirety of the clearance formed by the cutout s3 is closed by the oil return pipe 14 extending in the longitudinal direction. Thus, almost no lubricant oil enters the oil ring 15 through the minute clearance between the edge of the cutout s3 and the oil return pipe 14.

Figure 7:
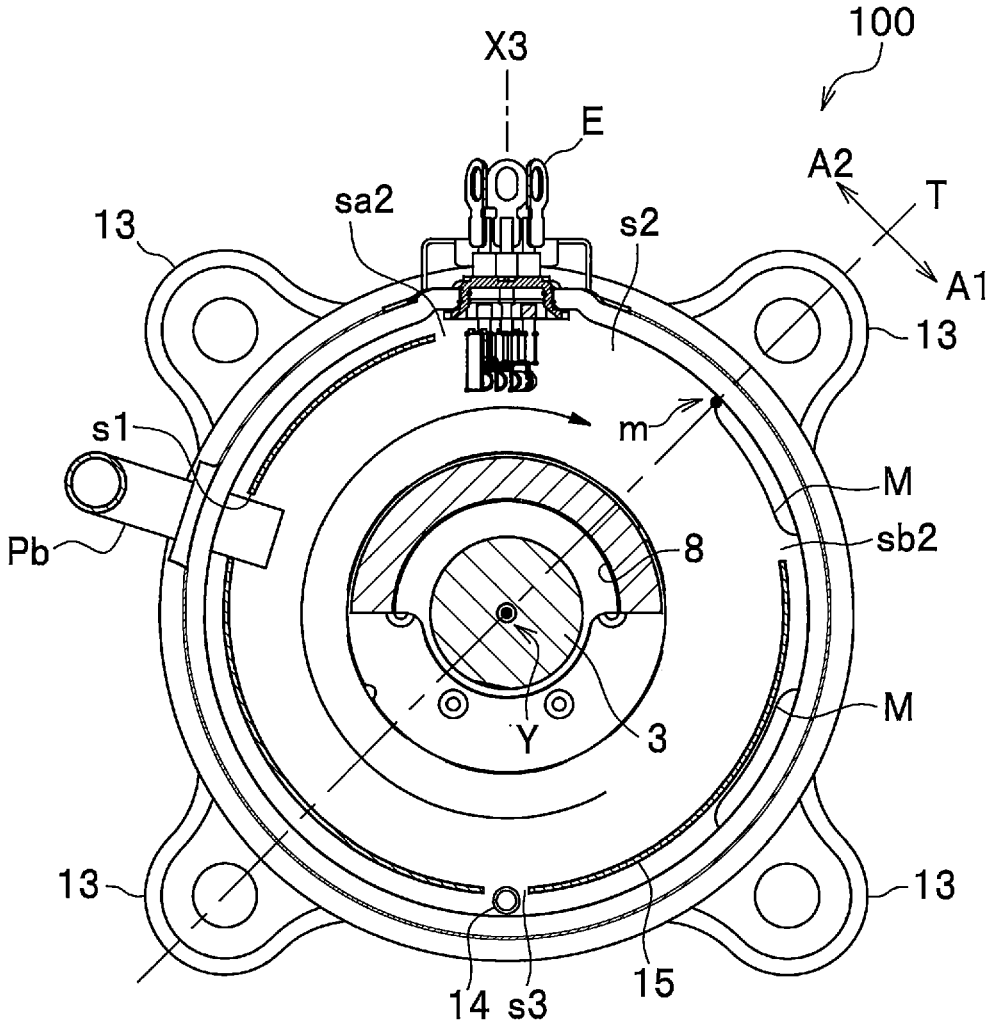
FIG. 7 is a cross-sectional view showing a positional relationship among refrigerant flow paths of a compression mechanism and cutouts of the oil ring in the compressor according to the first embodiment of the present invention.

FIG. 7 is a cross-sectional view showing a positional relationship among the refrigerant flow paths M of the compression mechanism and the cutouts s1, s2, s3 of the oil ring 15. Note that in FIG. 7, the electric motor 6 and the like are not shown in a section (a section similar to that of FIG. 6) in a case where the compressor 100 is cut along the X2-X2 line of FIG. 1. Moreover, the refrigerant flow paths M, the discharge pipe Pb, and the power supply terminal E not actually seen in a case where the compressor 100 is cut along the X2-X2 line of FIG. 1 are shown in a projected manner in FIG. 7 for the sake of description. Further, a position X3 shown as a position in the circumferential direction in FIG. 7 corresponds to a position X3 in FIG. 6. In addition, a clockwise arrow as viewed in the plane of paper of FIG. 7 indicates the direction of rotation of the crankshaft 3.

As shown in FIG. 7, in a case where the oil ring 15 is divided in half at a virtual plane T including the center axis Y of the crankshaft 3 and including an upstream end point m of the refrigerant flow path M (the second flow path) in the direction of rotation of the crankshaft 3, the following relationship is preferably satisfied. That is, in a case where the oil ring 15 is divided in half at the above-described virtual plane T, the side area of the oil ring 15 on one side A1 as a refrigerant flow path M side (the opposite side of the discharge pipe Pb) is preferably greater than the side area on the other side A2.

Description will be made from another point of view. At least part of the cutout s2 into which the power supply terminal E is inserted and the cutout s1 into which the discharge pipe Pb is inserted are preferably provided on the above-described other side A2. Further, the positions of the two refrigerant flow paths M in the circumferential direction are preferably unevenly on the opposite side of the discharge pipe Pb. According to such a configuration, refrigerant and the like having flowed out of the refrigerant flow paths M flows downward while revolving clockwise as viewed in the plane of paper of FIG. 7 through the clearance k (see FIG. 1) between one side A1 of the oil ring 15 and the hermetic container 1.

The side area of the oil ring 15 is greater on one side A1 than on the other side A2 (i.e., a clearance into which lubricant oil enters is narrow), and therefore, lubricant oil contained in refrigerant and the like is less likely to enter the oil ring 15 from one side A1. Most of lubricant oil having flowed out of the refrigerant flow paths M reaches the electric motor 6 while flowing on one side A1 of the oil ring 15, and is further guided to the lower side of the electric motor 6 through the oil flow paths N.

Note that in an example of FIG. 7, the refrigerant flow path M positioned on the upstream side in the direction of rotation of the crankshaft 3 overlaps, in the radial direction, with the wide portion sb2 (see FIG. 5) of the cutout s2 as viewed in a cross section. However, the depth of the cutout of the wide portion sb2 is shallow, and misty lubricant oil having flowed out of the upstream refrigerant flow path M flows down while revolving clockwise as viewed in the plane of paper of FIG. 7. Thus, almost no lubricant oil directly enters the oil ring 15 through a clearance formed by the wide portion sb2.

Moreover, in a case where the oil ring 15 is divided in half at the above-described virtual plane T, the cutout s1 into which the discharge pipe Pb is inserted is, at the oil ring 15, provided in a region on the opposite site of the refrigerant flow paths M (i.e., the other side A2), and part of the cutout s2 into which the power supply terminal E is inserted is present in such a region. With this configuration, entrance of lubricant oil moving while revolving after having flowed out of the refrigerant flow paths M into the oil ring 15 through the clearances formed by the cutouts s1, s2 can be reduced.

Regarding arrangement of the refrigerant flow paths M, the discharge pipe Pb, and the power supply terminal E in the circumferential direction, the refrigerant flow paths M, and the discharge pipe Pb, and the power supply terminal E are preferably arranged in this order in the direction of rotation of the crankshaft 3. According to such a configuration, a length in the circumferential direction from the refrigerant flow path M to the cutout s2 for the power supply terminal E can be sufficiently ensured. Thus, misty lubricant oil flowing down while revolving through the clearance k (see FIG. 1) between the oil ring 15 and the hermetic container 1 is guided to the lower side of the electric motor 6 through the oil flow paths N (see FIGS. 3 and 6) before reaching the cutout s2. As a result, entrance of the misty lubricant oil into the oil ring 15 can be reduced.

Note that a predetermined clearance is present on the lower side of the discharge pipe Pb in the cutout s1 (see FIG. 1). However, in a case where the oil ring 15 is divided in half at the above-described virtual plane T, the cutout s1 for the discharge pipe Pb is positioned on the other side A2 (see FIG. 7). Thus, almost no lubricant oil enters the oil ring 15 through the clearance formed by the cutout s1.

<Advantageous Effects>

According to the first embodiment, the upstream end of the discharge pipe Pb is positioned inside the oil ring 15 in the radial direction as shown in FIG. 1. This can suppress lubricant oil flowing in the annular clearance k between the oil ring 15 and the hermetic container 1 from flowing out through the discharge pipe Pb.

As shown in FIG. 2, the refrigerant flow paths M are unevenly provided on the opposite side of the discharge pipe Pb in the circumferential direction. With this configuration, the length in the circumferential direction from the refrigerant flow path M to the discharge pipe Pb as viewed in the cross section is sufficiently ensured. This can suppress misty lubricant oil flowing down in the refrigerant flow paths M from flowing out through the discharge pipe Pb.

As shown in FIG. 6, the oil ring 15 is provided inside each oil flow path N in the radial direction as viewed in the cross section. Thus, even in a case where misty lubricant oil is blown up through the oil flow paths N, entrance of such lubricant oil into the oil ring 15 can be reduced.

Regarding arrangement of the refrigerant flow paths M, the discharge pipe Pb, and the power supply terminal E in the circumferential direction, the refrigerant flow paths M, the discharge pipe Pb, and the power supply terminal E are arranged in this order in the direction of rotation of the crankshaft 3 as shown in FIG. 7. Thus, the length in the circumferential direction from the refrigerant flow path M to the cutout s2 for the power supply terminal E can be sufficiently ensured. As a result, entrance of misty lubricant oil into the oil ring 15 can be reduced.

As described above, according to the first embodiment, refrigerant and lubricant oil can be sufficiently separated from each other in the compressor 100. Thus, the compressor 100 capable of reducing outflow of lubricant oil to the outside of the compressor 100 through the discharge pipe Pb and having high reliability and performance with a simple structure can be provided.

Second Embodiment

In a second embodiment, an air-conditioner W (a refrigeration cycle device: see FIG. 8) including a compressor 100 (see FIG. 1) described in the first embodiment will be described.

Figure 8:
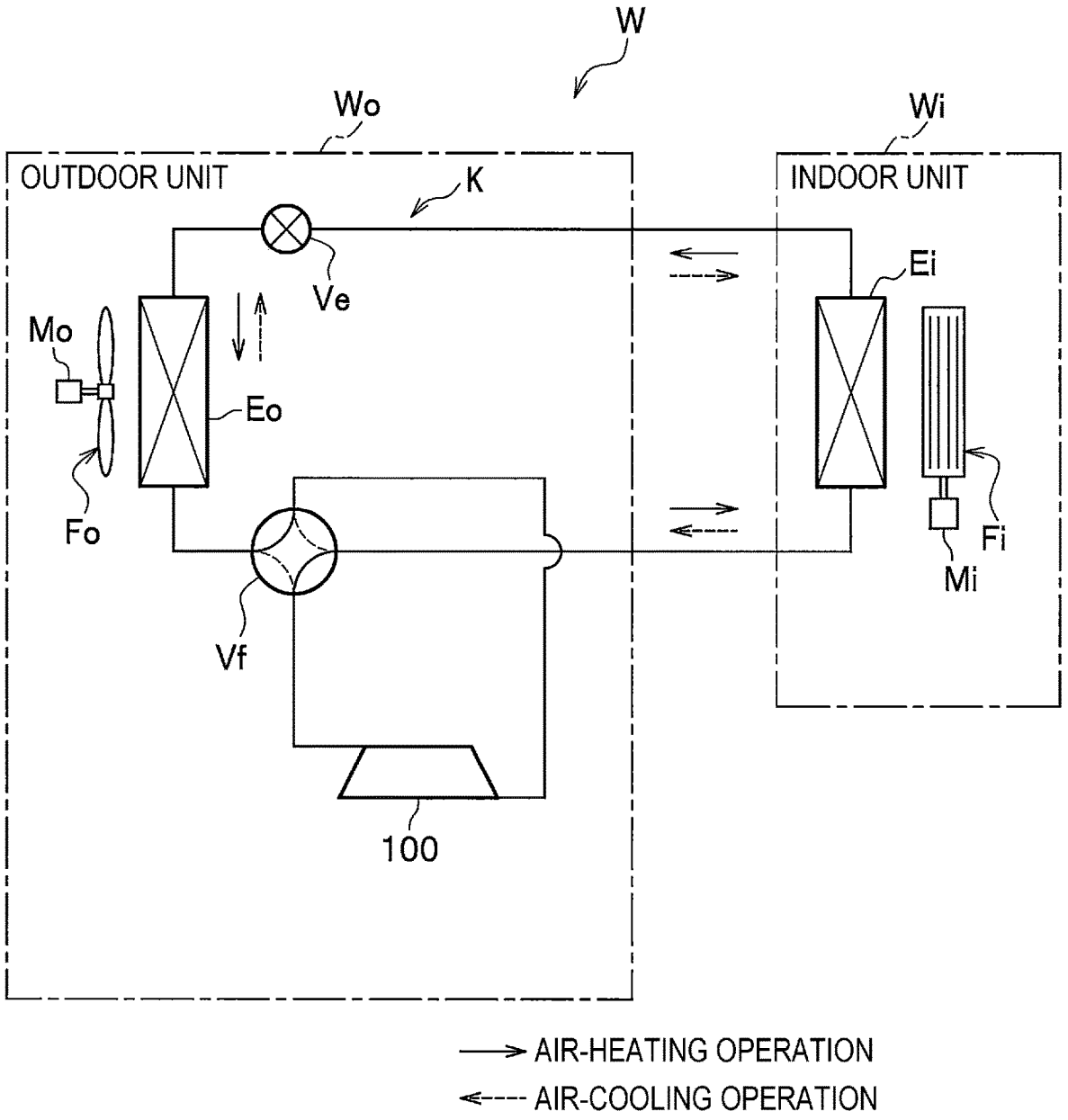
FIG. 8 is a configuration diagram of a refrigerant circuit of an air-conditioner according to a second embodiment of the present invention.

FIG. 8 is a configuration diagram of a refrigerant circuit K of the air-conditioner W according to the second embodiment. Note that solid arrows of FIG. 8 indicate the flow of refrigerant in air-heating operation. On the other hand, dashed arrows of FIG. 8 indicate the flow of refrigerant in air-cooling operation. The air-conditioner W is equipment configured to perform air-conditioning such as air-cooling or air-heating. As shown in FIG. 8, the air-conditioner W includes the compressor 100, an outdoor heat exchanger Eo, an outdoor fan Fo, an expansion valve Ve, a four-way valve Vf, an indoor heat exchanger Ei, and an indoor fan Fi.

In an example shown in FIG. 8, the compressor 100, the outdoor heat exchanger Eo, the outdoor fan Fo, the expansion valve Ve, and the four-way valve Vf are provided in an outdoor unit Wo. On the other hand, the indoor heat exchanger Ei and the indoor fan Fi are provided in an indoor unit Wi.

The compressor 100 is equipment configured to compress gaseous refrigerant, and has a configuration similar to that of the first embodiment (see FIG. 1). The outdoor heat exchanger Eo is a heat exchanger configured to exchange heat between refrigerant flowing in a heat transfer pipe (not shown) of the heat exchanger and external air sent from the outdoor fan Fo. The outdoor fan Fo is a fan configured to send external air into the outdoor heat exchanger Eo. The outdoor fan Fo includes an outdoor fan motor Mo as a drive source, and is placed in the vicinity of the outdoor heat exchanger Eo.

The indoor heat exchanger Ei is a heat exchanger configured to exchange heat between refrigerant flowing in a heat transfer pipe (not shown) of the heat exchanger and indoor air (air in an air-conditioning target space) sent from the indoor fan Fi. The indoor fan Fi is a fan configured to send indoor air into the indoor heat exchanger Ei. The indoor fan Fi includes an indoor fan motor Mi as a drive source, and is placed in the vicinity of the indoor heat exchanger Ei.

The expansion valve Ve is a valve configured to depressurize refrigerant condensed in a "condenser" (one of the outdoor heat exchanger Eo or the indoor heat exchanger Ei). Note that refrigerant depressurized by the expansion valve Ve is guided to an "evaporator" (the other one of the outdoor heat exchanger Eo or the indoor heat exchanger Ei).

The four-way valve Vf is a valve configured to switch a refrigerant flow path according to an operation mode of the air-conditioner W. For example, in the air-cooling operation (see the dashed arrows of FIG. 8), refrigerant circulates in a refrigeration cycle in the refrigerant circuit K configured such that the compressor 100, the outdoor heat exchanger Eo (the condenser), the expansion valve Ve, and the indoor heat exchanger Ei (the evaporator) are sequentially connected to each other through the four-way valve Vf.

On the other hand, in the air-heating operation (see the solid arrows of FIG. 8), refrigerant circulates in the refrigeration cycle in the refrigerant circuit K configured such that the compressor 100, the indoor heat exchanger Ei (the condenser), the expansion valve Ve, and the outdoor heat exchanger Eo (the evaporator) are sequentially connected to each other through the four-way valve Vf.

As described above, refrigerant circulates sequentially through the compressor 100, the "condenser," the expansion valve Ve, and the "evaporator." Note that equipment such as the compressor 100, the outdoor fan Fo, the expansion valve Ve, and the indoor fan Fi is driven based on a command from a control device (not shown).

<Advantageous Effects>

According to the second embodiment, outflow of lubricant oil from the compressor 100 can be reduced, and therefore, the reliability and performance of the air-conditioner W can be enhanced.

Variations

The compressor 100 and the air-conditioner W according to the present invention have been described above in each embodiment, but the present invention is not limited to the contents of such description and various changes can be made. For example, in the first embodiment, the configuration in which the three cutouts s1, s2, s3 are provided at the oil ring 15 (see FIG. 5) has been described, but the number of cutouts is not limited to such a number. That is, it may be configured such that at least one cutout is provided at the oil ring 15 and the discharge pipe Pb, the power supply terminal E, or the oil return pipe 14 is inserted into such a cutout.

It may be configured such that multiple ones (e.g., the discharge pipe Pb and the oil return pipe 14) of the discharge pipe Pb, the power supply terminal E, and the oil return pipe 14 are inserted into one cutout.

In the first embodiment, the configuration in which the two refrigerant flow paths M (the second flow paths: see FIG. 7) are provided at the compression mechanism 2 and the six oil flow paths N (the first flow paths: see FIG. 6) are provided at the core back 61*a* of the electric motor 6 has been described, but the number of refrigerant flow paths M and the number of oil flow paths N are not limited to these numbers. That is, it may be configured such that at least one refrigerant flow path M and at least one oil flow path N are provided.

Figure 9A:
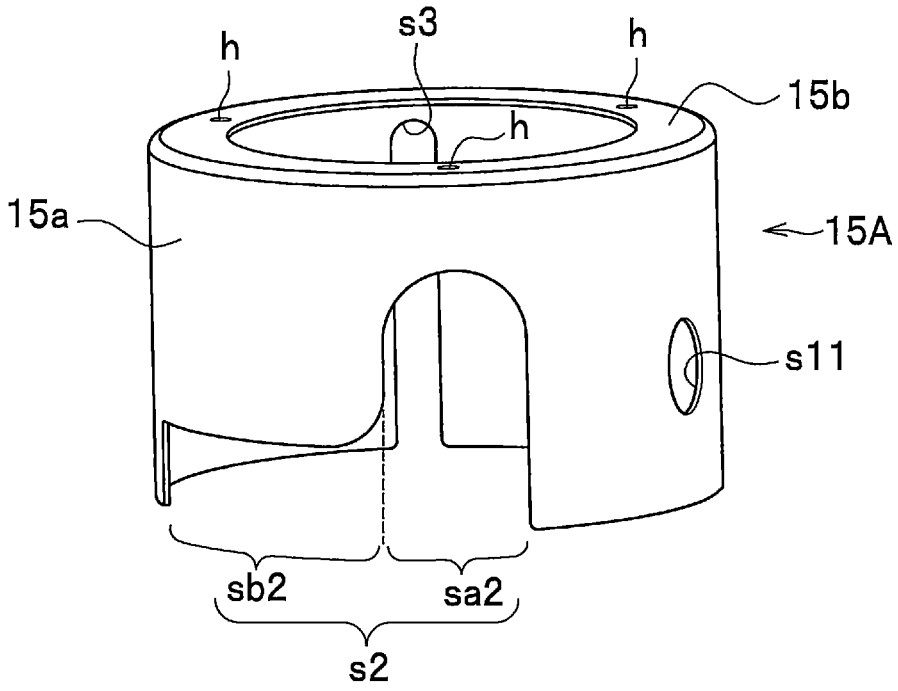
FIG. 9A is a perspective view of an oil ring included in a compressor according to a first variation of the present invention.

FIG. 9A is a perspective view of an oil ring 15A included in a compressor according to a first variation of the present invention. In the first embodiment, the configuration in which the cutouts s1, s2, s3 are provided at the oil ring 15 (see FIG. 5) has been described, but the present invention is not limited to such a configuration. For example, a hole s11 (the first insertion portion) into which the discharge pipe Pb (see FIG. 1) is inserted may be provided instead of the cutout s1, as shown in FIG. 9A. Note that the same also applies to the other cutouts s2, s3.

The hole s11 (the first insertion portion) into which the discharge pipe Pb is inserted is preferably provided at the lower portion of the oil ring 15. With this configuration, an adverse effect of the flow (turbulence) of refrigerant and the like inside the oil ring 15 on the flow of refrigerant and the like in the annular clearance k (see FIG. 1) is reduced, and the flow of refrigerant and the like is less likely to be disturbed. Note that the phrase of the hole s11 being provided at the "lower portion" of the oil ring 15 means that the area of part of the hole s11 present at the lower portion of the oil ring 15 is greater than the area of part of the hole s11 present at the upper portion of the oil ring 15.

A hole (not shown) may be provided instead of the cutout s2 shown in FIG. 9A. That is, it may be configured such that the cutout s2 or the hole (not shown) larger than the hole s11 (the first insertion portion) is, at the oil ring 15, provided as the "second insertion portion" into which the power supply terminal E (see FIG. 6) is inserted and the oil ring 15 is also present right above the power supply terminal E. Alternatively, a hole (not shown) may be provided instead of the cutout s3 shown in FIG. 9A. That is, it may be configured such that the cutout s3 or the hole (not shown) is, at the oil ring 15, provided as the "third insertion portion" into which the oil return pipe 14 (see FIG. 3) is inserted and the oil ring 15 is also present right above the oil return pipe 14.

Figure 9B:
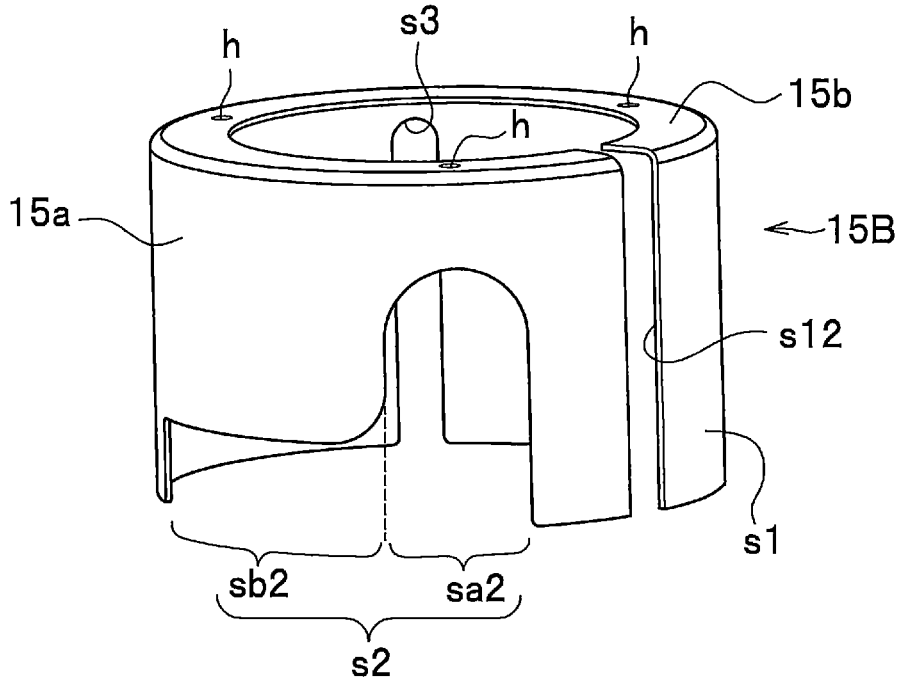
FIG. 9B is a perspective view of an oil ring included in a compressor according to a second variation of the present invention.

FIG. 9B is a perspective view of an oil ring 15B included in a compressor according to a second variation of the present invention. Instead of the cutout s1 (see FIG. 5) described in the first embodiment, a slit s12 may be provided to extend from an upper end to the lower end of the oil ring 15 and the discharge pipe Pb may be inserted into the slit s12, as shown in FIG. 9B. Note that the same also applies to the other cutouts s2, s3. Even in a case where the fixing portion 15*b* (the plate portion) lacks part thereof in the circumferential direction (i.e., the fixing portion 15*b* is not in a circular ring shape) as in the above-described example, if the following size relationship is satisfied, such a case is included in a matter that "the upstream end of the discharge pipe Pb (see FIG. 1) is, as viewed in plane, provided between the inner end portion of the fixing portion 15*b* (the plate portion) in the radial direction and the outer end portion of the fixing portion 15*b* (the plate portion) in the radial direction." That is, a configuration in which a second distance from the center axis Y (not shown in FIG. 9B, see FIG. 1) of the crankshaft 3 to the upstream end of the discharge pipe Pb is longer than a first distance from the center axis Y to the inner end portion (an optional location in the circumferential direction other than the slit s12) of the fixing portion 15*b* in the radial direction and a third distance from the center axis Y to the outer end portion of the fixing portion 15*b* in the radial direction is longer than the second distance is also included in the above-described matter. As another alternative, two or three of the cutout, the hole, and the slit may be mixed as the shapes of the "first insertion portion" into which the discharge pipe Pb is inserted, the "second insertion portion" into which the power supply terminal E is inserted, and the "third insertion portion" into which the oil return pipe 14 is inserted.

In the above-described configuration, the discharge pipe Pb may be inserted into at least one cutout (e.g., the cutout s1: see FIG. 5), hole (e.g., the hole s11: see FIG. 9A), or slit (e.g., the slit s12: see FIG. 9B) provided in a region on the opposite side of the refrigerant flow path M side.

Note that in the configuration in which the slit (not shown) is provided at the oil ring 15, the oil ring 15 may be provided in an area extending from the upstream end point m (see FIG. 7) of the refrigerant flow path M to the position of insertion of the discharge pipe Pb in the circumferential direction. Even with such a configuration, outflow of lubricant oil, which has flowed out of the refrigerant flow paths M, through the discharge pipe Pb can be reduced.

Figure 10:
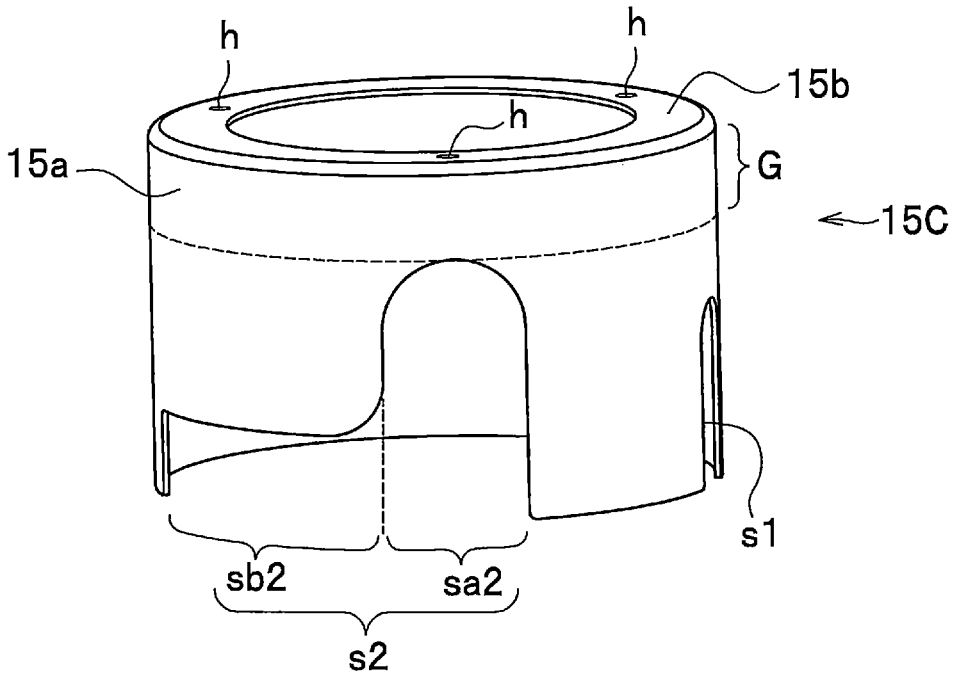
FIG. 10 is a perspective view of an oil ring included in a compressor according to a third variation of the present invention.

FIG. 10 is a perspective view of an oil ring 15C included in a compressor according to a third variation. The oil ring 15C shown in FIG. 10 is configured such that the cutout s3 into which the oil return pipe 14 (see FIG. 3) is inserted is omitted from the oil ring 15 (see FIG. 5) described in the first embodiment. Even with this configuration, advantageous effects similar to those of the first embodiment are provided.

As shown in FIG. 10, at the oil ring 15C, a region G (a cylindrical region) where the oil ring 15C is present is provided across the entire circumference in the circumferential direction at least at part of the upper side (the upper side with respect to the cutout s1) with respect to the discharge pipe Pb (see FIG. 1). Note that the region (a reference numeral is not shown in FIG. 5) where the oil ring 15 (see FIG. 5) is present is also provided across the entire circumference in the circumferential direction in the first embodiment, but the vertical width of the region G is longer in the third variation.

Figure 11:
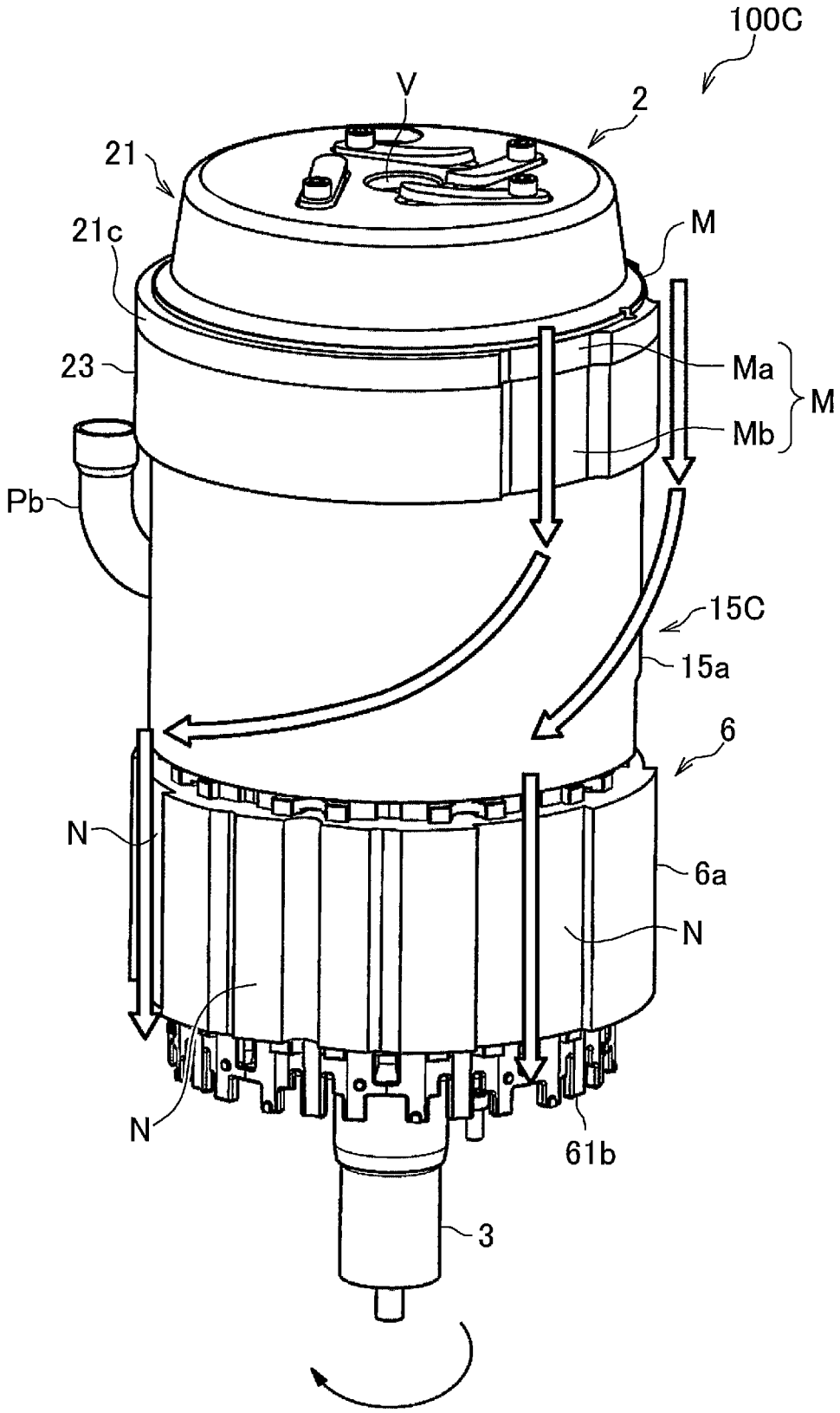
FIG. 11 is a perspective view in a state in which a hermetic container and the like of the compressor according to the third variation of the present invention are removed.

FIG. 11 is a perspective view in a state in which a hermetic container and the like of a compressor 100C according to the third variation are removed. With the above-described region G (see FIG. 10), the flow of refrigerant flowing down while moderately revolving through the annular clearance k (see FIG. 1) between the oil ring 15C and the hermetic container 1 (see FIG. 1) is likely to be generated. Moreover, misty lubricant oil is likely to turn into oil droplets on an outer peripheral surface of the oil ring 15C and the inner wall surface of the hermetic container 1 in the course of flowing in the annular clearance k (see FIG. 1). Thus, outflow of lubricant oil through the discharge pipe Pb can be reduced.

Figure 12:
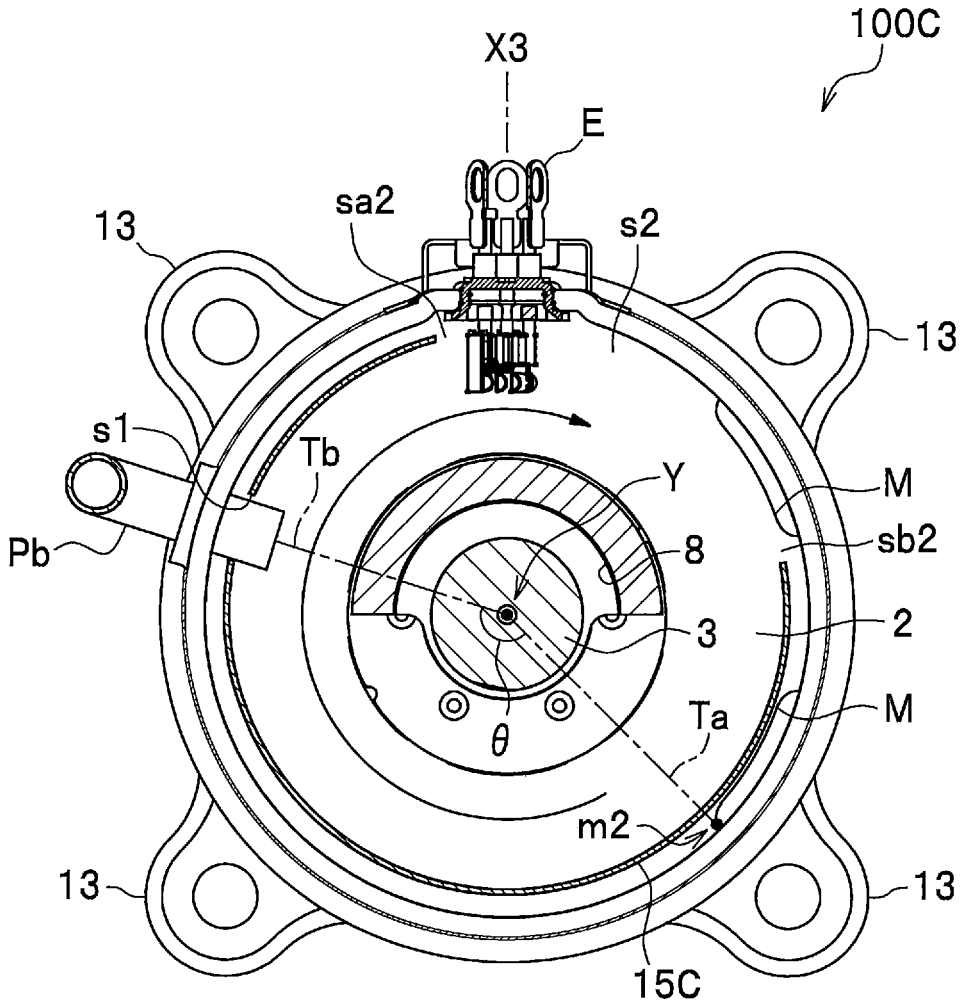
FIG. 12 is a cross-sectional view showing a positional relationship among refrigerant flow paths of a compression mechanism and cutouts of the oil ring in the compressor according to the third variation of the present invention.

FIG. 12 is a cross-sectional view showing a positional relationship among the refrigerant flow paths M of the compression mechanism and the cutouts s1, s2 of the oil ring in the compressor 100C according to the third variation. Note that FIG. 12 is similar to FIG. 7, except that the oil return pipe 14 (see FIG. 7) and the cutout s3 (see FIG. 7) are omitted. The two refrigerant flow paths M (the second flow paths) are provided at the compression mechanism 2 shown in FIG. 12. The cutout s1 (the first insertion portion) is, in the direction of rotation of the crankshaft 3 (the drive shaft), provided at a position apart from a most-downstream end point m2 of the multiple refrigerant flow paths M in the circumferential direction by 90° or greater. That is, an angle θ between a virtual plane Ta including the center axis Y and passing through the end point m2 and a virtual plane Tb including the center axis Y and passing through the vicinity of the upstream end of the discharge pipe Pb is equal to or greater than 90°. No predetermined cutout or hole is preferably provided between the above-described end point m2 and the cutout s1 in the circumferential direction in the direction of rotation of the crankshaft 3. According to such a configuration, refrigerant and the like flowing down while revolving sequentially through the refrigerant flow paths M and the annular clearance k (see FIG. 1) are less likely to enter the oil ring 15C. In combination with separation of the upstream end of the discharge pipe Pb and the refrigerant flow paths M by the oil ring 15C, outflow of lubricant oil through the discharge pipe Pb can be further reduced.

Note that a predetermined cutout or hole (e.g., the cutout s3 described in the first embodiment: see FIG. 7) may be provided between the above-described end point m2 and the cutout s1. In such a configuration, the area of the predetermined cutout or hole described above is preferably smaller than the area of the cutout s1. This can suppress misty lubricant oil from entering the oil ring 15 through the predetermined cutout or hole. Note that the definition of the "area" of the cutout is as described above.

In each embodiment, the configuration in which the compressor 100 is placed in a vertical orientation has been described, but the present invention is not limited to such a configuration. For example, each embodiment can be also applied to a configuration in which the compressor 100 is placed in a horizontal orientation. Moreover, in each embodiment, the case where the compressor 100 is a scroll compressor has been described, but the present invention is not limited to such a case. That is, each embodiment can be also applied to another type of compressor such as a rotary type. Further, each embodiment is limited to the case where the oil ring 15 is made of metal, but the present invention is not limited to such a case. For example, the oil ring 15 may be made of resin. In addition, in each embodiment, the case where among the cutouts s1, s2, s3 (see FIG. 5) of the oil ring 15, the length of the cutout s2 in the circumferential direction is longest and the length of the cutout s3 in the circumferential direction is shortest has been described, but the present invention is not limited to such a case. That is, the magnitude relationship of the lengths of the cutouts s1, s2, s3 in the circumferential direction can be changed as necessary. Similarly, the magnitude relationship of the lengths of the cutouts s1, s2, s3 in the axial direction can be also changed as necessary.

In the second embodiment, the air-conditioner W (the refrigeration cycle device: see FIG. 8) including the compressor 100 has been described, but the present invention is not limited to the air-conditioner W. For example, the second embodiment can be also applied to other "refrigeration cycle devices" such as a refrigerator, a water heater, an air-conditioning water-heating device, and a chiller.

Each embodiment has been described in detail for the sake of simplicity in description of the present invention, and is not limited to one including all configurations described above. Addition/omission/replacement of other configurations can be made to some of the configurations of each embodiment, as necessary. The mechanisms and configurations necessary for description have been described above, and all mechanisms and configurations necessary for a product are not necessarily described.

LIST OF REFERENCE SIGNS

100 Compressor
1 Hermetic Container
2 Compression Mechanism
21 Fixed Scroll
22 Revolving Scroll
23 Frame
3 Crankshaft (Drive Shaft)
4 Main Bearing
5 Revolving Bearing
6 Electric Motor
6*a* Stator
61*a* Core Back
61*b* Winding
6*b* Rotor
7 Oldham Ring
8 Balance Weight
9 Sub-Frame
10 Auxiliary Bearing
11 Oil Supply Pump

12 Thrust Bearing
13 Leg
14 Oil Return Pipe
15 Oil Ring (Partition Wall)
15*a* Cylindrical Portion
15*b* Fixing Portion (Plate Portion)
A1 One Side
A2 Other Side
D Space
E Power Supply Terminal
G Region
i Movement Front Surface
j Movement Back Surface
k Clearance
m2 End Point
M Refrigerant Flow Path (Second Flow Path)
Ma Groove
Mb Groove
N Oil Flow Path (First Flow Path)
Pa Suction Pipe
Pb Discharge Pipe
R Oil Sump
s1 Cutout (First Insertion Portion)
s11 Hole (First Insertion Portion)
s12 Slit
s2 Cutout (Second Insertion Portion)
s3 Cutout (Third Insertion Portion)
T Virtual Plane
Y Center Axis

The invention claimed is:

1. A compressor comprising:

a hermetic container sealed with lubricant oil;

an electric motor placed inside the hermetic container and having a stator and a rotor;

a drive shaft configured to rotate integrally with the rotor;

a compression mechanism configured to compress gas in association with rotation of the drive shaft;

a discharge pipe configured to guide the gas compressed in the compression mechanism to an outside of the hermetic container;

a tubular partition wall provided between the compression mechanism and the electric motor; and a balance weight provided inside the partition wall in a radial direction in a space on a lower side of the compression mechanism and an upper side of the electric motor and configured to rotate integrally with the drive shaft, wherein a cutout or a hole is, at a lower portion of the partition wall, provided as a first insertion portion into which the discharge pipe is inserted, at least one first flow path connecting one side and the other side of the stator in an axial direction is, at the stator, provided as a groove provided at an outer peripheral wall of the stator, at least one second flow path connecting one side and the other side of the compression mechanism in an axial direction of the drive shaft is, at the compression mechanism, provided as a groove provided at an outer peripheral wall of the compression mechanism, a clearance is formed between the partition wall and the hermetic container, an upstream end of the discharge pipe is provided at a position inside the clearance divided by the partition wall between upper and lower surfaces of the balance weight in the axial direction of the drive shaft, gas having flowed down through the second flow path flows down while revolving through the clearance, the gas having flowed down while revolving through the clearance is guided to a lower side of the electric motor through the first flow path, a peripheral wall of the tubular partition wall is provided outside an inner peripheral surface of the stator in a radial direction, and the upstream end of the discharge pipe is also provided outside the inner peripheral surface of the stator in the radial direction.

2. An air-conditioner comprising:

an outdoor unit having the compressor according to claim 1; and an indoor unit.

3. A compressor comprising:

a hermetic container sealed with lubricant oil;

an electric motor placed inside the hermetic container and having a stator and a rotor;

a drive shaft configured to rotate integrally with the rotor;

a compression mechanism configured to compress gas in association with rotation of the drive shaft;

a discharge pipe configured to guide the gas compressed in the compression mechanism to an outside of the hermetic container;

a tubular partition wall provided between the compression mechanism and the electric motor; and a balance weight provided inside the partition wall in a radial direction in a space on a lower side of the compression mechanism and an upper side of the electric motor and configured to rotate integrally with the drive shaft, wherein a cutout or a hole is, at a lower portion of the partition wall, provided as a first insertion portion into which the discharge pipe is inserted, at least one first flow path connecting one side and the other side of the stator in an axial direction is, at the stator, provided as a groove provided at an outer peripheral wall of the stator, at least one second flow path connecting one side and the other side of the compression mechanism in an axial direction of the drive shaft is, at the compression mechanism, provided as a groove provided at an outer peripheral wall of the compression mechanism, a clearance is formed between the partition wall and the hermetic container, an upstream end of the discharge pipe is provided at a position inside the clearance divided by the partition wall between upper and lower surfaces of the balance weight in the axial direction of the drive shaft, gas having flowed down through the second flow path flows down while revolving through the clearance, the gas having flowed down while revolving through the clearance is guided to a lower side of the electric motor through the first flow path, and the partition wall is provided outside a winding of the stator in a radial direction.

4. The compressor according to claim 3, wherein the gas compressed in the compression mechanism is discharged toward a ceiling surface of the hermetic container through a discharge port of the compression mechanism, the second flow path is provided only outside the compression mechanism, and a predetermined space is provided between the electric motor and the partition wall in the axial direction of the drive shaft.

5. The compressor according to claim 3, wherein the first insertion portion is a cutout provided at a lower end of the partition wall.

6. The compressor according to claim 3, wherein at the partition wall, a region where the partition wall is present is provided across an entire circumference in a circumferential direction at least at part of an upper side with respect to the discharge pipe.

7. The compressor according to claim 3, wherein the compression mechanism has a frame fixed to the hermetic container, the tubular partition wall has a circular ring-shaped plate portion extending inward of an upper end in the radial direction, the plate portion is fixed to the frame, the upstream end of the discharge pipe is, as viewed in plane, provided between an inner end portion of the plate portion in the radial direction and an outer end portion of the plate portion in the radial direction.

8. The compressor according to claim 3, further comprising:

a power supply terminal connected to the electric motor, wherein a predetermined cutout or hole is, at the lower portion of the partition wall, provided as a second insertion portion into which the power supply terminal is inserted, the second flow path includes multiple second flow paths provided at the compression mechanism, and in a direction of rotation of the drive shaft, an upstream one of the second flow paths overlaps, in the radial direction, with a downstream portion of the second insertion portion as viewed in a cross section.

9. The compressor according to claim 3, wherein the balance weight has an annular portion in an annular shape and an arc portion in an arc shape as viewed in a cross section, the annular portion is fixed to the drive shaft with the drive shaft being inserted into a hole of the annular portion, and the arc portion extends to one side in the axial direction from the annular portion.

10. An air-conditioner comprising:

an outdoor unit having the compressor according to claim 3; and an indoor unit.

* * * * *